US009235949B2

(12) United States Patent
Elliott

(10) Patent No.: US 9,235,949 B2
(45) Date of Patent: Jan. 12, 2016

(54) POINT-OF-SALE INTEGRATED STORAGE DEVICES, SYSTEMS FOR PROGRAMMING INTEGRATED STORAGE DEVICES, AND METHODS FOR PROVIDING CUSTOM SOUNDS TO TOYS

(75) Inventor: Brandon Elliott, St. Charles, MO (US)

(73) Assignee: BUILD-A-BEAR Retail Management, Inc., St. Louis, MO (US)

( * ) Notice: Subject to any disclaimer, the term of this patent is extended or adjusted under 35 U.S.C. 154(b) by 497 days.

(21) Appl. No.: 13/467,812

(22) Filed: May 9, 2012

(65) Prior Publication Data

US 2012/0289122 A1 Nov. 15, 2012

Related U.S. Application Data

(60) Provisional application No. 61/484,124, filed on May 9, 2011.

(51) Int. Cl.

| | |
|---|---|
| ***A63F 5/00*** | (2006.01) |
| ***G07F 17/16*** | (2006.01) |
| ***A63H 3/02*** | (2006.01) |
| ***A63H 3/28*** | (2006.01) |

(52) U.S. Cl.

CPC *G07F 17/16* (2013.01); *A63H 3/02* (2013.01); *A63H 3/28* (2013.01)

(58) Field of Classification Search

CPC ..... A63H 5/00
USPC ..... 446/397
IPC ..... A63H 5/00
See application file for complete search history.

(56) References Cited

U.S. PATENT DOCUMENTS

| | | | | |
|---|---|---|---|---|
| 5,334,022 | A | 8/1994 | Kitagawa et al. | |
| 5,451,178 | A | 9/1995 | Yorozu et al. | |
| 6,012,961 | A | 1/2000 | Sharpe, III et al. | |
| 6,206,750 | B1 | 3/2001 | Barad et al. | |
| 6,312,307 | B1 * | 11/2001 | Dean, II | 446/297 |
| 6,463,257 | B1 | 10/2002 | Wood | |
| 6,547,635 | B1 | 4/2003 | Gildea | |
| 6,578,527 | B1 * | 6/2003 | Mathers | 119/707 |

(Continued)

FOREIGN PATENT DOCUMENTS

| | | |
|---|---|---|
| EP | 2 311 536 A1 | 4/2011 |
| JP | 2008279165 A | 11/2008 |

(Continued)

OTHER PUBLICATIONS

International Search Report, International Patent Application No. PCT/US13/43308, mailed on Aug. 23, 2013, 12 pages.

(Continued)

*Primary Examiner* — Michael Dennis
*Assistant Examiner* — Dolores Collins
(74) *Attorney, Agent, or Firm* — Lewis Rice LLC

(57) ABSTRACT

Systems and methods which allow for the self-service selection and recording of local storage devices which can be provided as part of a larger object such as a toy. Specifically, the systems and methods discussed herein generally comprise self-service kiosks or other related systems whereby a final consumer, who is engaged in the manufacture or creation of a personalized or semi-personalized toy, can provide for transfer of sound or other data to a local storage device which will be incorporated into the toy in an on-demand fashion.

12 Claims, 29 Drawing Sheets

(56) References Cited

U.S. PATENT DOCUMENTS

| | | | | |
|---|---|---|---|---|
| 6,761,634 | B1 | 7/2004 | Peterson et al. | |
| 7,296,482 | B2 * | 11/2007 | Schaffer et al. | 73/861 |
| 7,645,178 | B1 | 1/2010 | Trotto et al. | |
| 8,128,450 | B2 | 3/2012 | Imai | |
| 8,287,327 | B1 | 10/2012 | Ghaly | |
| 8,358,286 | B2 | 1/2013 | Cannon | |
| 8,408,143 | B2 * | 4/2013 | Severson | 105/1.5 |
| 8,450,592 | B2 * | 5/2013 | Feng et al. | 84/626 |
| 8,460,052 | B2 * | 6/2013 | Ganz | 446/175 |
| 8,500,511 | B2 * | 8/2013 | Ganz | 446/175 |
| 8,548,819 | B2 * | 10/2013 | Chan et al. | 705/1.1 |
| 8,641,471 | B2 * | 2/2014 | Ganz | 446/175 |
| 8,827,760 | B2 * | 9/2014 | Ushibo et al. | 446/73 |
| 2001/0041494 | A1 | 11/2001 | Barad et al. | |
| 2001/0056359 | A1 | 12/2001 | Abreu | |
| 2002/0061707 | A1 | 5/2002 | Barad et al. | |
| 2002/0073191 | A1 | 6/2002 | Perkowski | |
| 2002/0106964 | A1 | 8/2002 | Gaynor et al. | |
| 2002/0117544 | A1 | 8/2002 | Wolf et al. | |
| 2002/0132553 | A1 | 9/2002 | Jelinek | |
| 2002/0142834 | A1 | 10/2002 | Sobue | |
| 2002/0169687 | A1 | 11/2002 | Perkowski | |
| 2002/0170961 | A1 | 11/2002 | Dickson et al. | |
| 2003/0083807 | A1 | 5/2003 | Kuroda et al. | |
| 2003/0110099 | A1 | 6/2003 | Trajkovic et al. | |
| 2003/0148698 | A1 | 8/2003 | Koening | |
| 2004/0074377 | A1 | 4/2004 | Georges | |
| 2004/0080530 | A1 | 4/2004 | Lee | |
| 2004/0214642 | A1 | 10/2004 | Beck | |
| 2005/0080666 | A1 | 4/2005 | Treibetz et al. | |
| 2005/0106991 | A1 | 5/2005 | Marine et al. | |
| 2005/0148281 | A1 | 7/2005 | Sanchez-Castro et al. | |
| 2006/0234601 | A1 | 10/2006 | Weston | |
| 2006/0293101 | A1 | 12/2006 | Kogo | |
| 2007/0128979 | A1 | 6/2007 | Shackelford et al. | |
| 2007/0143679 | A1 | 6/2007 | Resner | |
| 2007/0236485 | A1 | 10/2007 | Trepte | |
| 2007/0253581 | A1 * | 11/2007 | Sutton | 381/124 |
| 2008/0261486 | A1 * | 10/2008 | Parajon et al. | 446/404 |
| 2008/0263454 | A1 | 10/2008 | Chan et al. | |
| 2009/0068920 | A1 | 3/2009 | Brielmann | |
| 2009/0069084 | A1 | 3/2009 | Reece et al. | |
| 2009/0158210 | A1 | 6/2009 | Cheng et al. | |
| 2011/0021109 | A1 | 1/2011 | Le et al. | |
| 2012/0019480 | A1 | 1/2012 | Cannon | |
| 2012/0041839 | A1 | 2/2012 | Weiss et al. | |
| 2012/0046102 | A1 | 2/2012 | Tully | |
| 2013/0303047 | A1 | 11/2013 | Albert et al. | |
| 2014/0256214 | A1 * | 9/2014 | Ramamoorthy et al. | 446/297 |

FOREIGN PATENT DOCUMENTS

| | | | |
|---|---|---|---|
| NL | 1013422 | C2 | 5/2001 |
| WO | 00/30117 | A1 | 5/2000 |
| WO | 2004068452 | A2 | 8/2004 |

OTHER PUBLICATIONS

International Search Report, International Patent Application No. PCT/US13/053774, mailed on Oct. 25, 2013, 10 pages.

International Search Report, International Patent Application No. PCT/US2012/037125, mailed Nov. 23, 2012, 8 pages.

Extended Search Report, European Patent Application No. 12782005.8, Nov. 11, 2014, 6 pages.

* cited by examiner

POINT-OF-SALE INTEGRATED STORAGE DEVICES, SYSTEMS FOR PROGRAMMING INTEGRATED STORAGE DEVICES, AND METHODS FOR PROVIDING CUSTOM SOUNDS TO TOYS

CROSS REFERENCE TO RELATED APPLICATION(S)

This Application claims the benefit of U.S. Provisional Patent Application Ser. No. 61/484,124 filed May 9, 2011, the entire disclosure of which is incorporated herein by reference.

BACKGROUND

1. Field of the Invention

This disclosure relates to systems and methods for recording of data, specifically sounds, on a local storage device which is included as a portion of a larger object such as a toy. Specifically this disclosure relates to customer self-service local storage device recording for use in systems where final consumers participate in the manufacturing process of plush toys, and interactivity provided by having such a local storage device as a part of toys.

2. Description of the Related Art

As the world has become more advanced, virtually every aspect of human existence has incorporated new technologies. In many respects, toys, generally objects used for play to train children for future life and often designed to be versions of objects used by adults, have been around for as long as mankind Because toys are designed for play intended to teach behavior, as the world has changed, toys have changed to allow for children to play with objects that have become commonplace.

Prior to the invention of the telephone, there was no need for toy telephones. Similarly, prior to the invention of the automobile, there were no toy cars or trucks. While the types of toys emulate the environment in which children grow, toys also gain increased functionality as technology provides for better and safer ways to incorporate into toys functionalities that are provided by devices that are often sophisticated machines more so than playthings.

An early toy telephone may look like a telephone, but generally did not provide for parts that operated like those of a real telephone. However, as technology has improved, toy telephones now incorporate moveable buttons which control computer chips so that the telephone not only can be manipulated like a real telephone, but can be interactive and provide tactile, audible, and visual stimulation and feedback.

One major advancement in toys is the ability of them to provide audible stimulation (sound). Originally, sounds were often provided by mechanical means, such as by having a bell that movement of a component of the toy would strike. While this was effective for certain sounds and types of toys, this type of technology could not produce complicated sounds such as speech and is often only suitable for certain limited applications.

With the commoditization of recording technologies, the ability to include sound in toys suddenly became feasible. Toys have traditionally had fixed recorded chips where the push of a specific button or a particular activation of a toy could produce a specific series of associated sounds. For example, a toy tractor may make engine noise as the toy moved across the floor, or a recording of a farmer's speech may play when a button associated with him is pressed.

While the ability to include such recorded sound in a toy was an advancement because it allowed for sounds to be reproduced from a recording instead of created by the toy, the consumer had no control over the sounds included. Instead, the sounds were preprogrammed and preassembled into components of the toy. Thus, the consumer was stuck with whatever sounds the toy had regardless as to the desirability of these sounds to the child, or the annoyance of the sounds to the parent.

One area where sound in toys is particularly common is in plush toys. As these toys are often used by the child as a comfort object, the ability for the toy to issue soothing or reassuring sounds, or to provide sounds or speech associated with parents can be particularly desirable. Plush toys commonly include sound devices to allow them to tell stories, to speak certain phrases, and even to emulate sounds in a mother's womb.

Even as sound provision has become more sophisticated, with audio tape players being replaced by solid state chips and MP3 compression technology, one thing has generally remained the same when it came to sounds in toys: the final consumer is always limited by available sounds to those that have been prerecorded on the sound device and included with the toy. Specifically, the chips only have sounds chosen by the manufacturer. Even toys which included sophisticated sound players such as integrated cassette decks (e.g., Teddy Ruxpin™) are often limited to having to use prerecorded media of the manufacturer in order for the media to interact with the toy.

In the last 15 years, the manufacturing process of toys has become additionally personalized through the advent of toy stores where the toy is not just purchased off a rack, but is manufactured by the child themselves. One such type of store is the Build-a-Bear Workshop™ store where a person can construct a toy from various provided components. Part of the entertainment value of the toy is the ability of the child to be part of the toy's process of manufacture. In these types of on-demand and self-service manufacturing methodologies, the child is present for the toy's creation and construction, and the toy is often more personalized because the child has made personal decisions about the design of the toy. This can include decisions as to the toy's design and what additional components or functionality it includes.

In effect, the toy becomes more capable of reflecting the toy's owner because its owner is also, in many respects, its creator. This is beneficial both for children in making customized toys and for toys which are given to the child. The latter instance often has a more personal connection as associated with the person who made and gave the toy to the child because of the personalization. Further, the very process of building a toy is "play" which emulates modern manufacturing and construction techniques. Further, toy stores are also becoming play destinations where the toy is viewed as a "friend" or "companion" allowed to take part in the child's activities instead of an inanimate object.

One of the personalizations of these customer manufactured toys is sound. Traditionally, construction of a toy by a final consumer allows for the selection by the final consumer as to whether or not to include a sound chip for provision of sound in the toy, but the final consumer was still limited to the sounds provided on prerecorded chips. While technology existed which allowed recording a custom sound (e.g., the voice of the person creating the toy), other sounds could not be used due to licensing concerns and the difficulty in programming a device at the point-of-sale and on-demand by the final consumer. For example, if the final consumer wanted a toy to play a specific song, that song had to be available on a prerecorded chip: there was no way for the song to be recorded for the consumer at the point they were making the decision as to whether to add sound to the toy.

This situation presented two problems. In the first instance, the person's selection was dictated by the manufacturer and the number of available professionally produced sounds was generally limited by available inventory space. Secondly, the party providing the local storage devices for inclusion had to choose sound material of widespread interest because otherwise they could end up with dead stock of sound chips including less desirable sounds that could result in a significant wasted investment.

SUMMARY

Because of these and other problems in the art, described herein, among other things, are systems and methods which allow for the self-service selection and recording of local storage devices which can be provided as part of a larger object, such as, but not limited to a toy. Specifically, the systems and methods discussed herein will generally comprise self-service kiosks or other related systems whereby a final consumer, who is engaged in the manufacture or creation of a personalized or semi-personalized toy, can provide for transfer of sound or other data to a local storage device which will be incorporated into the toy in an on-demand fashion.

The local storage device can be recorded with an instantly generated sound, for example the final consumer speaking, or can be recorded with a wide variety of prerecorded sounds from a library of stored sounds. In this way, the local storage device is stored in a "non-recorded" state up until the final consumer selects a sound for it and records it onto the local storage device. However, once the final consumer has incorporated the local storage device into the toy, the sound on the local storage device is relatively static and unchangeable unless specific steps are taken to alter it.

There is described herein, in an embodiment, a system for providing sound to a toy, the system comprising: a local storage device, the local storage device including: a local memory; and a speaker for reproducing sounds recorded on the local memory; a kiosk, the kiosk including: a cradle for detecting the presence of a local storage device; a kiosk memory including a library of sounds; and a processor for transferring a sound from the library of sounds on the kiosk memory to the local memory on the local storage device; and a toy; wherein a final consumer instructs the processor to transfer the sound from the kiosk memory to the local memory; and wherein the local storage device is placed in the toy by the final consumer after the sound is transferred from the kiosk memory to the local memory.

In an embodiment of the system, the local storage device must be placed in the cradle for the processor to transfer the sound which may occur wirelessly.

In an embodiment of the system, the final consumer interacts with the kiosk via a touchscreen.

In an embodiment of the system, the toy comprises a plush toy.

In an embodiment of the system, the kiosk further comprises a microphone. Sound is generated by the final consumer using the microphone and may be processed by sound processing software for modifying the sound. The recorded sound may also be stored on a memory remote from the kiosk.

In an embodiment of the system, the final consumer can load a sound from a remote memory into the kiosk memory.

In an embodiment of the system, the kiosk identifies the toy such as through the use of a machine readable indicia associated with the toy.

There is also described herein a toy comprising: an outer shell; a local storage device placed within the outer shell, the local storage device including: a local memory; and a speaker for reproducing sounds recorded on the local memory; wherein a final consumer can record sounds on the local memory at a recording center accessible to the final consumer; wherein the final consumer places the local storage device in the outer shell; and wherein the sounds on the local memory can be altered when the toy is at the recording center but cannot be altered when the toy is not at the recording center.

There is also described herein a method for providing sound to a toy, the method comprising: providing a toy to a final consumer prior to the toy being assembled; providing a local storage device to a final consumer; providing a recording station to a final consumer, the recording station including: a cradle for detecting the presence of a local storage device; a microphone; and a processor for transferring a sound from the recording station to the local memory on the local storage device; the final consumer placing a local storage device in the cradle; the final consumer recording a sound to the recording station using the microphone; the final consumer instructing the processor to transfer the sound to the local storage device; and the final consumer placing the local storage device in the toy after the sound is transferred but before assembly of the toy is completed.

In an embodiment of the method, the toy comprises a plush toy.

In an embodiment of the method, the processor modifies the sound prior to the final consumer instructing the processor to transfer the sound to the local storage device.

In an embodiment of the method, the processor transfers the sound to a memory remote from the local storage device and the recording station.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment.

DESCRIPTION OF THE PREFERRED EMBODIMENT(S)

Figure 1:
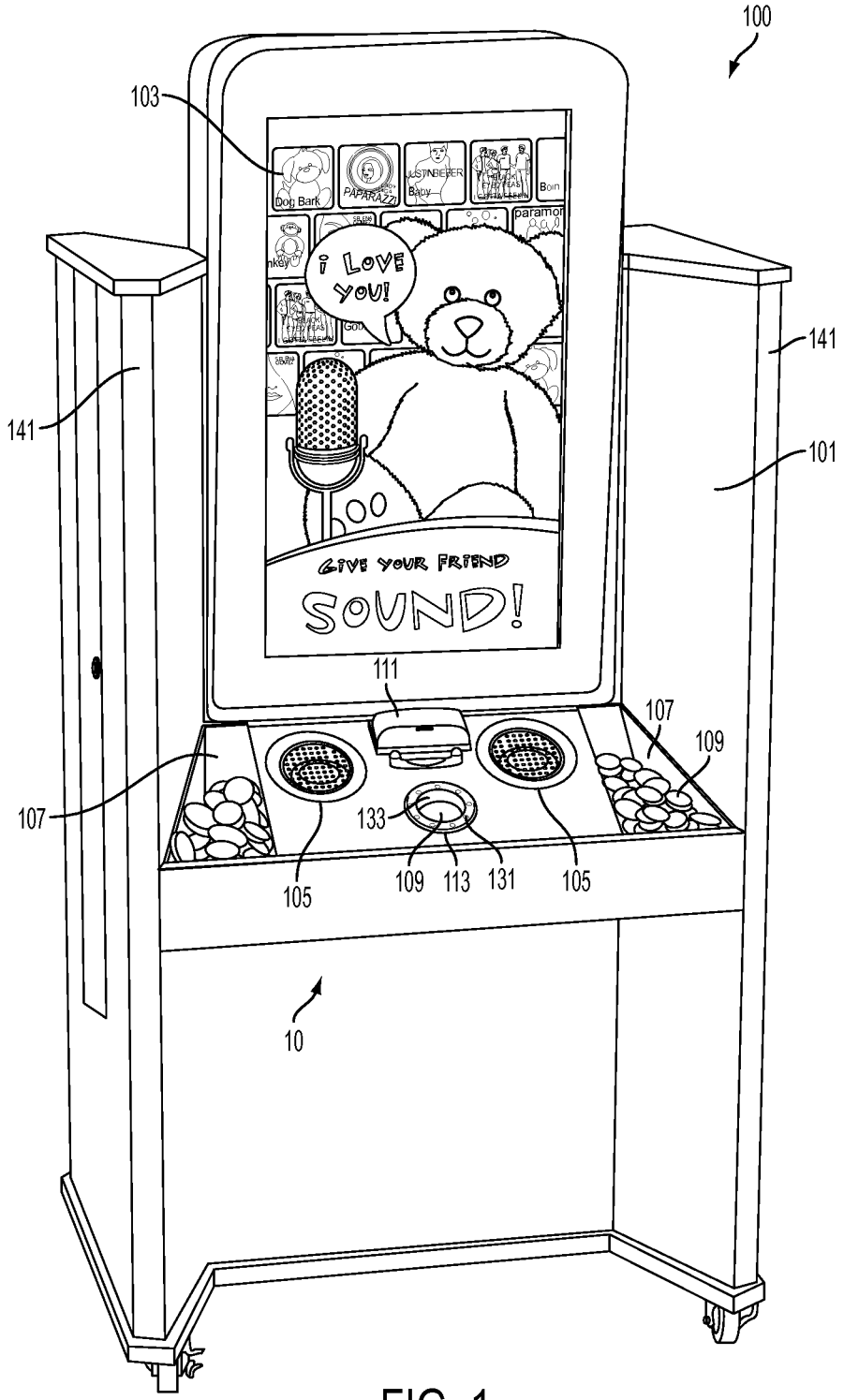
FIG. 1 provides a perspective view of a final consumer self-service kiosk that provides for sound transfer to a local storage device for use in the construction of a toy.

It is important to recognize that, for the purposes of this application, the differences between a sound chip which has been prerecorded with a sound, a sound chip which can have instantaneously generated sound recorded thereon, and a local storage device that can have a sound recorded thereon from a library of selections. A sound chip where a sound is prerecorded generally will be unable to record over the sound without sophisticated machinery (and generally cannot be rerecorded over at all). Therefore, a prerecorded chip must be purchased and provided with a specific sound already on it. This involves the need for inventory and means that sounds cannot be selected at the time of purchase other than from a prerecorded inventory.

A recordable chip whereby the final consumer can generate a sound and have it recorded to the chip is also very different from such a local storage device. Most recordable chips require sophisticated recording apparatus in order to transfer the sound to the chip. Thus, while a purchase can be made of a chip to be recorded with a sound, the chip often must be recorded at a professional manufacturing facility and cannot be done in a true self-service manufacturing context. Those few chips that can be recorded by the end final consumer often suffer because they are relatively easy to record over, have poor recording quality, and/or often require bulky electronics. Thus, a final consumer can often inadvertently record over the original recording, which is often highly undesirable, could potentially place unlicensed protected data on the devices, which could lead to liability, and inclusion of such devices in smaller items, such as toys, is often undesirable due to size. Further, both the above types of chips generally cannot provide interactive data.

The local storage device (109) of the type discussed herein can have a sound recorded on it from a generally accessible recording system (10). That is, recording can be done in a self-service fashion by the final consumer at or around the point-of-sale, can be part of a final consumer initiated and driven on-demand manufacturing process, and can allow for the final consumer to have additional control over the final toy. The process and systems to perform the transfer of data to the local storage device (109) are ultimately designed so that the local storage device (109) is capable of having a large number of different recordings placed thereon, but once the local storage device (109) is removed from a purposeful tool for programming it (system (10)), it has a local memory which is relatively difficult to overwrite. This may be referred to in the disclosure as the local storage device (109) being in a "non-recorded" state prior to sound being placed thereon, but being in a "semi-permanent" state once sound is placed thereon.

As discussed herein, the term "final consumer" is used to refer to the individual that is purchasing the resulting object (toy) for their use, for the use of a relative (e.g., their child), or as a gift for another. The "final consumer" is not manufacturing the toy for resale and the manufacturing process for a final consumer is generally singularized. That is, the final consumer will generally only construct one (or a small number) of objects in any single experience and will do so under a specific controlled environment.

In a preferred embodiment, the local storage device (109) can be rerecorded repeatedly so long as the local storage device (109) is purposefully provided to a recording center. Thus, a flawed recording can be recorded over and the local storage device (109) does not have a fixed sound once recorded but, once removed from that area, is relatively difficult to rerecord over to provide permanence to the sound and the associated toy. The differentiation may often be because of the type of memory used as part of the recording media. Specifically, a recordable local storage device (109) can allow for local memory to be recorded over within the local storage device (109) in certain specific situations. A prerecorded chip will generally have memory that, once assigned, cannot be altered and a recordable chip will generally be readily recorded again regardless of location or design.

Throughout this disclosure, the device which includes the sound will be referred to as a local storage device (109). One embodiment of a local storage device (109) is shown in the various images of FIG. 4. The local storage device (109) will generally be a hardware digital device in the form of a chipset having onboard memory, communication tools, and means of sound reproduction enclosed in a housing, but it should be recognized that this specific arrangement is not required. The local storage device (109) may be created as any form of device that is capable of recording and then reproducing specific sound where the recording requires access to an external system and the reproduction does not.

This disclosure will generally focus on systems (10) which are designed to provide for recording of local storage devices (109) that are used as part of a final consumer self-service manufacturing process. Such processes are well known and one common example is provided in toy stores known under the Build-a-Bear Workshop™ name. In these types of stores, a final consumer is provided with a variety of raw materials which they combine in a variety of ways in order to create an end product which is a toy and specifically a customized plush toy.

While the systems and methods discussed herein are generally well suited to this environment, it should be recognized that the systems and methods can provide for customization potential to already premanufactured goods by providing the ability to alter factory settings or customize use and can therefore be used in a variety of other environments as well. The environment of a final consumer manufactured toy is not required in alternative embodiments of the systems and methods discussed herein.

Figure 2:
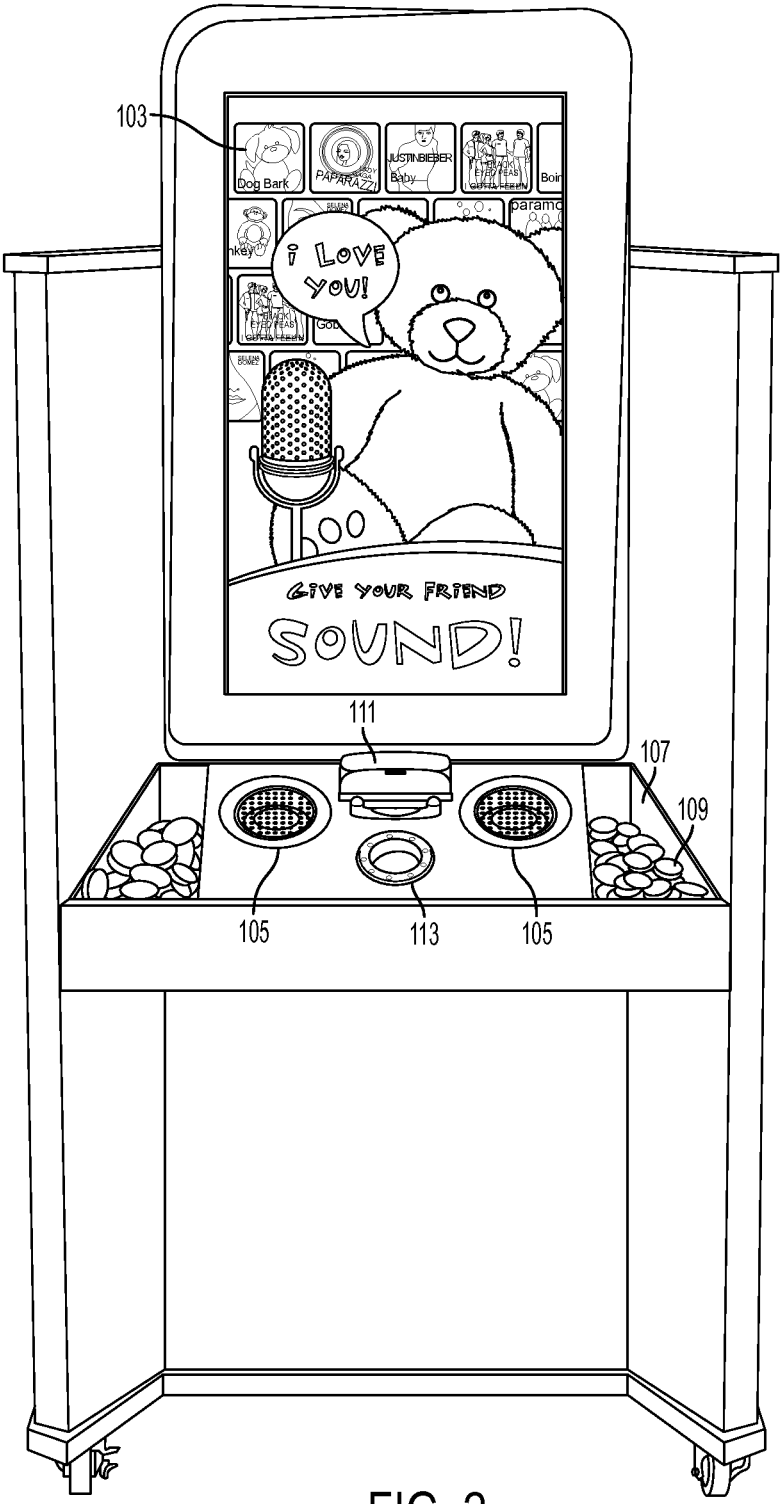
FIG. 2 provides a front view of the kiosk of FIG. 1.
Figure 3:
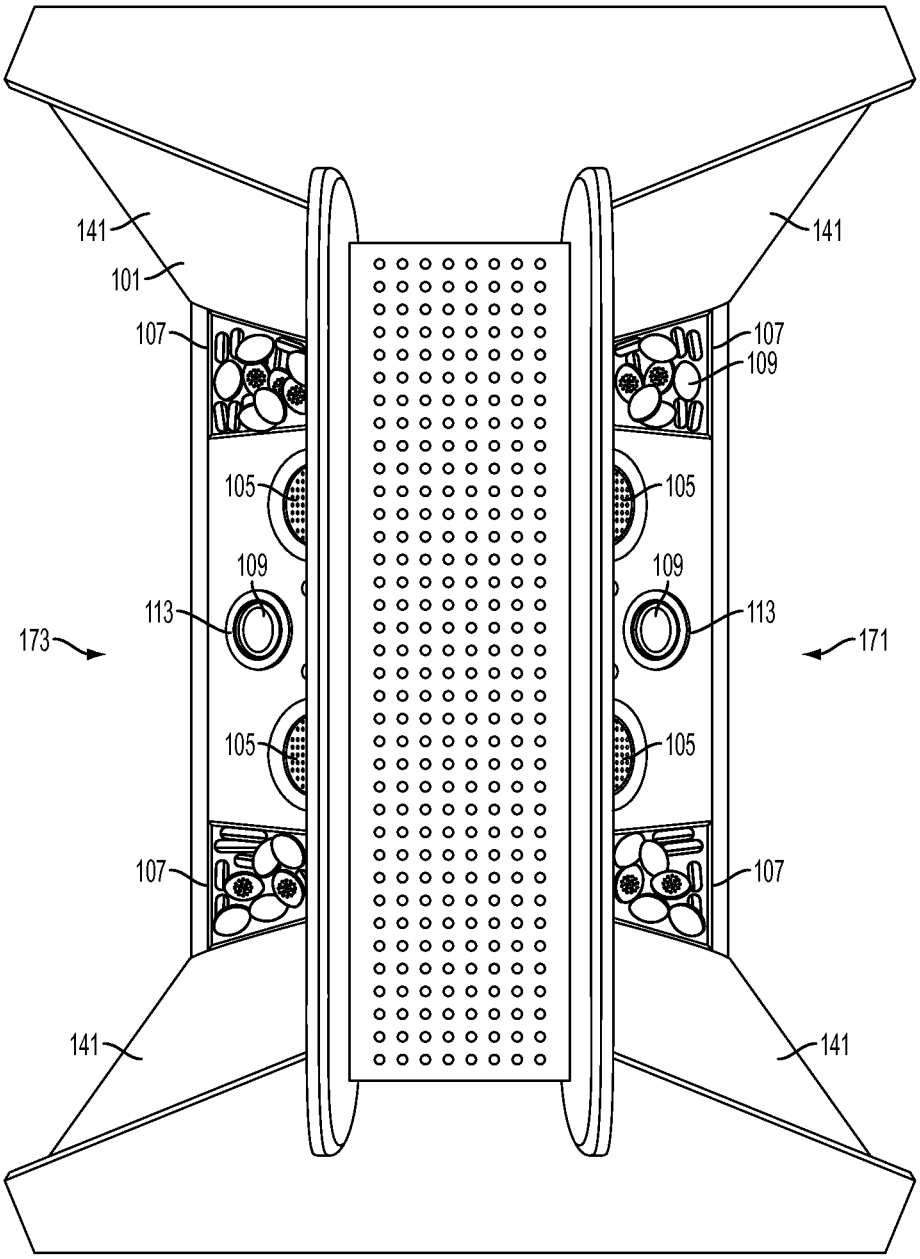
FIG. 3 provides a top view of the kiosk of FIG. 1.
Figure 27:
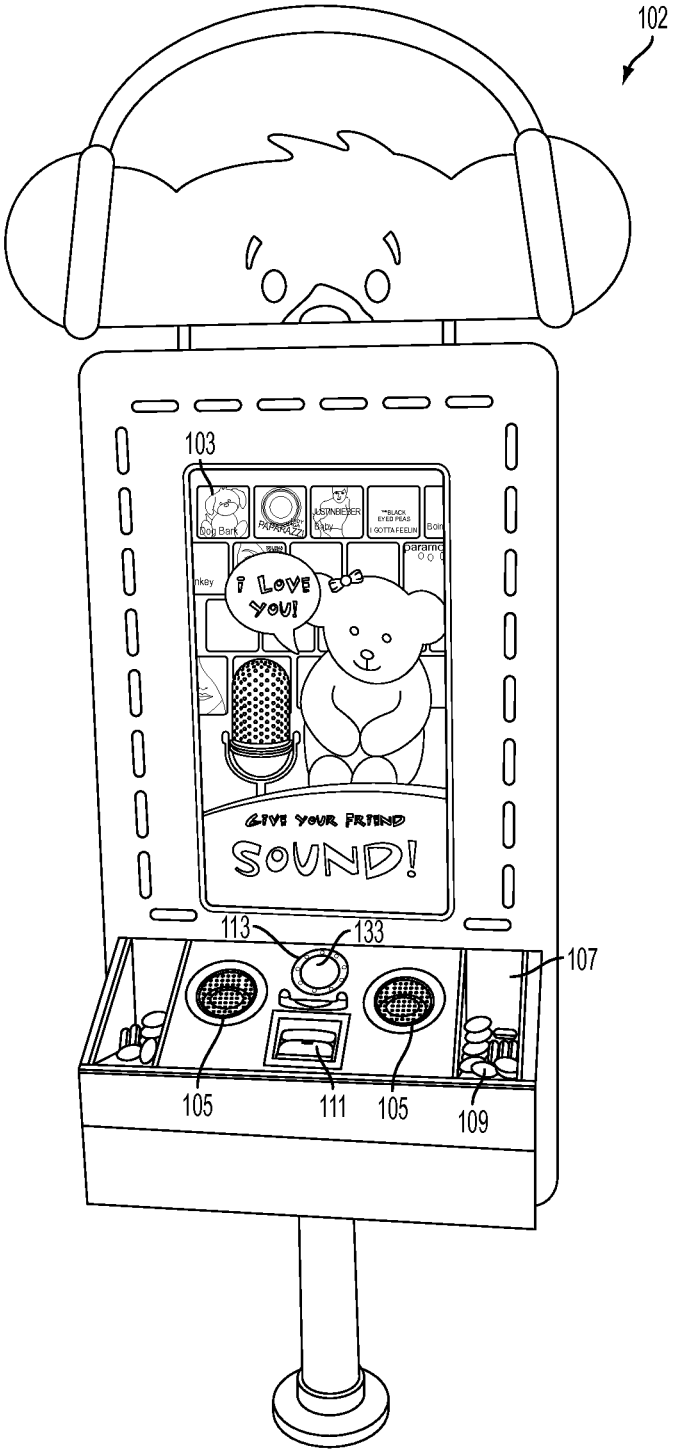
FIG. 27 shows an alternative embodiment of a kiosk.

FIGS. 1-3 provide for various depictions of an embodiment of a self-supporting two-station kiosk (100) enclosing a system (10) which may be used to provide for customized sound to a manufactured object during a self-service manufacturing process. FIG. 27 shows an alternative embodiment of a kiosk (102) which is only one-sided and therefore designed to be positioned against a wall. Throughout this disclosure, this document will refer to the object as a toy and specifically as a plush toy such as, but not limited to, a teddy bear. As plush toys, and particularly plush animals, are often used as comfort objects by children and are often anthropomorphized by children to have human characteristics, the personalization need for such toys is often much stronger than for toys which are representative of less personal objects. For this reason, the ability of plush toys to create sounds, whether those be sound effects, songs, spoken phrases, names, music, or "natural"

sounds (for example, a plush dog which can issue the sound of a dog bark) is often particularly desirable. However, this discussion is specifically not limited to the use of the systems and methods in plush toys and may be used anywhere and in any object where personalization of sound and data in the object is desired.

The kiosk (100) of FIGS. 1-3 and kiosk (102) of FIG. 27 are generally designed to be used in conjunction with a store whereby customization of toys, and specifically plush toys, is available. In many cases, this will be a store or other outlet where the plush toys are assembled by the final consumer with the assembly of the toy being considered part of the entertainment value of the toy as a whole. However, it may also be used in situations where the toys are already constructed, but where the final consumer is able to customize the toy, and in standard manufacturing situations where the ability to simply select sounds from a larger library at the time of manufacture is desirable. Similarly, the kiosk (100) will generally be used prior to ultimate purchase of the customized toy, but may also be provided as an additional feature for customization after purchase either as a further feature, or for additional charge. In an alternative embodiment, the kiosk (100) is replaced by a portable device (such as, but not limited to, a tablet or laptop computer), which includes similar functionality and may include connected specialized components such as the cradle (113) to perform the same function. Such a portable device may be used in conjunction with a toy assembly process to allow for mobile sales and resolve pressure of queues or lack of sufficient space for larger systems and/or to use in conjunction with toy accessories.

The kiosk (100) generally comprises a variety of different components. The kiosk (100) generally comprises a housing (101) which serves to give the kiosk (100) structure and to allow the kiosk (100) to be easily viewed and interacted with. The housing (101) also serves to enclose functional elements of a computer system including, but not limited to, a processor, a kiosk memory, and other functional computer components known to those of ordinary skill which provide the kiosk (100) with desired functionality and interactivity. In the depicted embodiment, the housing (101) is designed so as to provide for two opposing use stations (171) and (173) where a final consumer can interact with the kiosk (100) and control the system (10) for programming a local storage device (109). The kiosk (102) of FIG. 27 has only a single station.

Interaction with the final consumer in the depicted embodiment occurs through a visual display (which in the depicted embodiment comprises a touchscreen (103)) while audio interaction occurs through speakers (105). The speakers (105) and other components of the kiosks (100) may also include visual elements to provide for improved interactivity and attractiveness of display. None of these components are required, however. The kiosk (100) generally will able to provide indications of when it needs instructions, and systems to receive those instructions from a final consumer. A large number of such different types of interactivity are well known to those of ordinary skill in the art.

The kiosk (100) will also generally include an interface whereby the final consumer can provide instructions to the functional elements (e.g., processor) of the system (10) to carry out the process of selecting and recording the local storage device (109) as the final consumer desires. In the depicted embodiment, this functionality is provided by interactive touch screen (103) in conjunction with the visual display provided by the same touch screen (103); however, this functionality may be provided by buttons, keyboards, or other devices known to those of ordinary skill in the art.

The kiosk (100) also includes bins (107) which each include a plurality of "blank" local storage devices (109). The local storage devices (109) are referred to as "blank" as they have not been integrated into a resulting toy at this time and do not include a meaningful recording. It is possible that the local storage devices (109) may have a sound recorded on them, for example, if a person recorded a local storage device (109) and then determined that they did not want it and returned it to the bin (107). However, as discussed, since the local storage devices (109) are generally rerecordable, a "blank" local storage device (109) can be used for the recordation of sound as discussed later even if it already included a sound and a final consumer of the kiosk (100) would not be attempting to locate a local storage device (109) with the desired recording already on it in the bins (107). In an embodiment, the bins (107) need not just store the local storage devices (109) but may also serve as a charging station for them or may serve as a recording station (e.g., cradle (113)) whereby all the chips in the bin (107) may be simultaneously recorded.

The above described components of the kiosk (100) are generally components that would be specific to a public access implementation of a local storage device (109) recording system (10). For example, this type of kiosk (100) would be present in a place where it could be accessed by final consumers. This can be within a retail environment where the local storage device (109) is sold as part of another product, within a retail environment where sales of the local storage device (109) are done independent of sales of another product, or within a non-retail vending environment where the kiosk (100) comprises the entire sale in and of itself.

The kiosk (100) functionality can also be provided in a personal interactive system. For example, the components discussed later can be provided as a standalone device which can be connected with personal interactive devices, such as a computer, television, or smartphone, to allow for the functionality of the kiosk (100) to be owned by an individual final consumer. It is important to recognize, however, that the local storage device (109) is generally incapable of having the contents of its memory altered without interaction with an external device such as the kiosk (100) to inhibit the local storage device (109) from being inadvertently recorded on or more specifically recorded on in a manner outside the control of the provider of the local storage device (109).

The kiosk (100) further includes elements related directly to the recording of the local storage devices (109) and association of the local storage device (109) to a particular toy. Cradle (113) provides for the connection between a local storage device (109) and the kiosk (100) to allow for a recording to be transferred from the kiosk (100) to the local storage device (109). The kiosk (100) also includes a reader (111) or other component which is designed to identify a specific toy with which the local storage device (109) is or will be associated. The reader could also be used to identify a user as an administrative user as discussed later.

The reader (111) is an optional component but can be desirable in that it increases personalization of the toy. In an embodiment, the toy would be named by the child and may also be provided with personality traits or specific features which make the toy unique from other toys even if they appear similar. Therefore, the ability to machine identify the toy (and/or the child) will allow for the child to easily identify the toy to the kiosk (100) so that the toy and/or final consumer can be referred to, for example, by name or picture or other identifying information, in the kiosk's (100) presented instructions and so that a profile can be built with respect to the toy (and/or the child) and thereby can be used to personalize the user experience, content, and interactivity within the store and outside the store.

The reader (111) can obtain information about the toy by reading an optical, magnetic, or other tag (including but not limited to bar codes and QR codes, as is well understood by one of skill in this field) which is associated with the specific toy such as by being attached to the outer shell of the toy. While a scan type bar code reader (111) is shown in FIGS. 1-3, the reader can also comprise a picture type reader, a laser reader, or other forms of machine identification system known now or later discovered. Information can then be obtained about the toy from a database or other memory which may be onboard the kiosk (100). Alternatively, the information may be accessible via a network connection to a central database of information about toys associated with or to be used with the system (10).

The cradle (113) is generally designed to provide for an easy interface between the local storage device (109) and the computer components of the system (10) encased in the kiosk (100) including the memory where sounds or other data to be transferred to the local storage device (109) are stored and the mechanisms for transferring that data to the local storage device (109). It should be recognized that a wide variety of connections can be used in different embodiments as the cradle (113). However, it is generally desired that the connection be simple and easy for both parents or grandparents (who may be technically unsophisticated) and children who may lack fine motor skills to operate. In an embodiment, the cradle (113) is effectively the storage bin (107) so that all local storage devices (109) are programmed at once.

Further, the cradle (113) will generally be designed in such a fashion that access to material that can be downloaded to the local storage device (109) is done so only with express permission of the party providing the local storage media (109). This insures that obtained data transferred to the local storage device (109) is not inadvertently lost or overwritten and that the transfer of copyrighted or otherwise protected material to the local storage media (109) is done under an appropriate license.

In the depicted embodiment, the cradle (113) comprises a generally circular, ovular, or elliptical depression (133) formed into a surface of the kiosk (100). The cradle (113) may include lights (131) or other visual objects which can serve to attract attention to it and, because of the generally rounded shape, can provide for an indication of the progression of recording a local storage device (109). Generally, the depression (133) is sized and shaped to easily have a local storage device (109) placed therein in the correct orientation for the local memory onboard the local storage device to be accessed by the system (10) via the cradle (113) and for data to be transmitted from the system (10) into that memory.

Figure 4A:
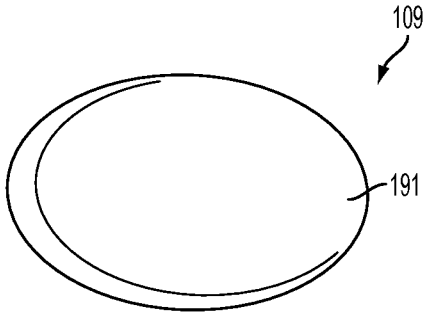
FIG. 4 provides various views of a local storage device.
Figure 4B:
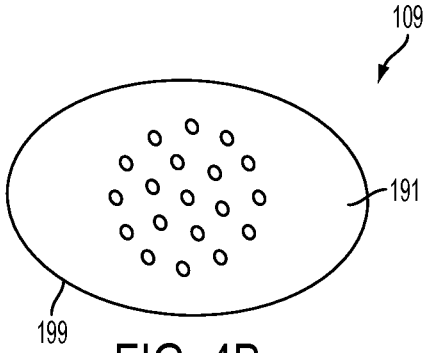
Figure 4C:
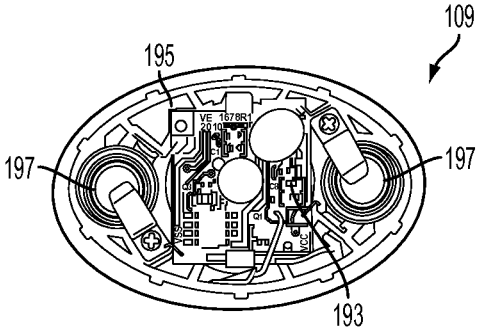

The local storage device (109) is best shown in FIG. 4. FIG. 4A shows a top view of the housing (191) of the local storage device (109). FIG. 4B shows a bottom view of the housing (191) and FIG. 4C shows the housing (191) opened. The local storage device generally comprises a chipset (193) which can include various components of functionality including a local onboard memory, a processor, a communication receiver and/or transmitter, and a control switch (195). The memory and processor are generally general purpose devices and therefore the local storage device (109) is not a dedicated audio device but simply a self-contained data storage object which can receive and transmit certain types of data under certain circumstances. In the depicted embodiment, the control switch (195) comprises a compression switch which is activated when the chip housing (191) is compressed. The chip (109) will also generally include a power source (197) and a speaker (199).

The local storage device (109) is generally constructed to be relatively rugged, so as to survive repeated use and activation as well as being designed to handle the rigors of play. As such, the housing (191) will often be constructed of plastic or another resilient material to protect more delicate internal components. The top and bottom of the housing (191) will generally be designed to lock together in a fashion that is difficult for children to open so as to inhibit a child from damaging internal components, or injuring themselves on internal components (such as by removing and swallowing the batteries). Such housing enclosure methods are well known to those of ordinary skill in the art. In the depicted embodiment, the local storage device (109) is generally a rough ovoid or similar shape such as, but not limited to, a cylinder, ovular cylinder, pill-shape, and other similar shapes. However, the local storage device (109) can be of any shape in different embodiments.

In the depicted embodiment, connection between the local storage device (109) and the cradle (113) is generally made using a short range wireless connection. While a wired connection can be used in other embodiments, the wireless connection is generally preferred as it eliminates the need for electronic components being visible on the outside of the housing and means that there is no need to manipulate wire connectors in order to attach the local storage device (109) to the kiosk (100). Further, a close range between transmitter and receiver for successful transmission is generally preferred as it provides that the local storage device (109) is only programmable when it is placed in the cradle (113).

In the depicted embodiment, the wireless transmitter requires the local storage device (109) to be placed in the cradle (113) with the correct side up. This close proximity can be desired as it means a local storage device (109) that is nearby is not inadvertently recorded to and the final consumer is generally not able to rerecord to the local storage device (109) unless they have access to a cradle (113) and computer systems capable of operating the cradle (113) and memory including data for transfer. However, because of the necessity of proximity, there is concern that the local storage device (109) can be mispositioned. To inhibit this, the cradle (113) can be specifically designed to assist a final consumer in correctly placing the local storage device (109) in the cradle (113) in the correct manner to make sure that recordation is a relatively straightforward process.

In the depicted embodiment, the wireless communication is performed by a proximity system whereby the speaker on the local storage device (109) can be operated in reverse as a receiver from a transmitter located in the lower surface of the depression (133) of the cradle (113). This is, however, by no means necessary, and any form of receiver and/or transmitter including those that utilize WiFi, Bluetooth, cellular, PCS, RFID, or any other form of wireless communication known now or later discovered can be used in alternative embodiments.

FIGS. 5-26 provide for various screenshots of an embodiment of programming placed on the system (10) which forms displays indicating various forms of interaction with the kiosk (100). The final consumer would follow these screenshots, providing input to the system (10), where appropriate, to implement the transfer of data from the system (10) the local storage device (109). As these screenshots provide for a good way of examining operation of the kiosk (100) and the programming systems (10) and methodologies, the final consumer will be walked through in order to show an embodiment of operation of the kiosk (100).

The kiosk (100) will generally operate in some form of attract loop which will be playing on the visual display (103) when the kiosk (100) is otherwise not in use. This acts both as a screensaver for the visual display (103) and to attract attention to the kiosk (100). A screenshot of the type common to such attract loops is shown on the display (103) in FIGS. 1 and 2. When a final consumer is interested in interacting with the kiosk (100), their presence will generally be detected and the system (10) will begin active operation. Detection may occur may be by sensing the final consumer (or toy) coming into proximity with the kiosk (100), for example by entering area (171) or (173), by scanning a code on a toy, or through the final consumer touching the screen (103) during the attract loop.

Figure 5A:
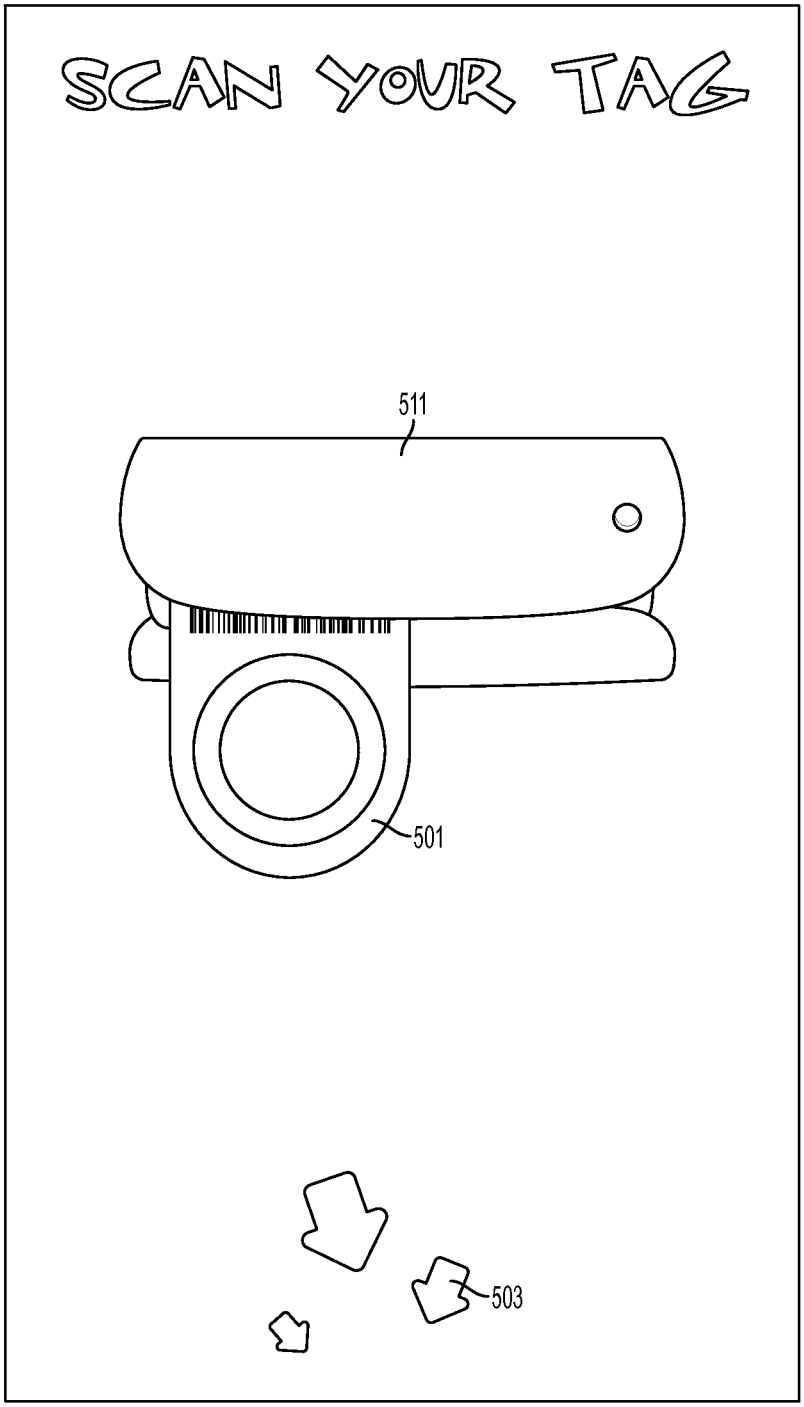
FIGS. 5A, 5B, and 6 provide for various screenshots related to an embodiment of software for activating the kiosk of FIGS. 1-3 and for connecting it to a target toy with which the local storage device is to be placed.
Figure 5B:
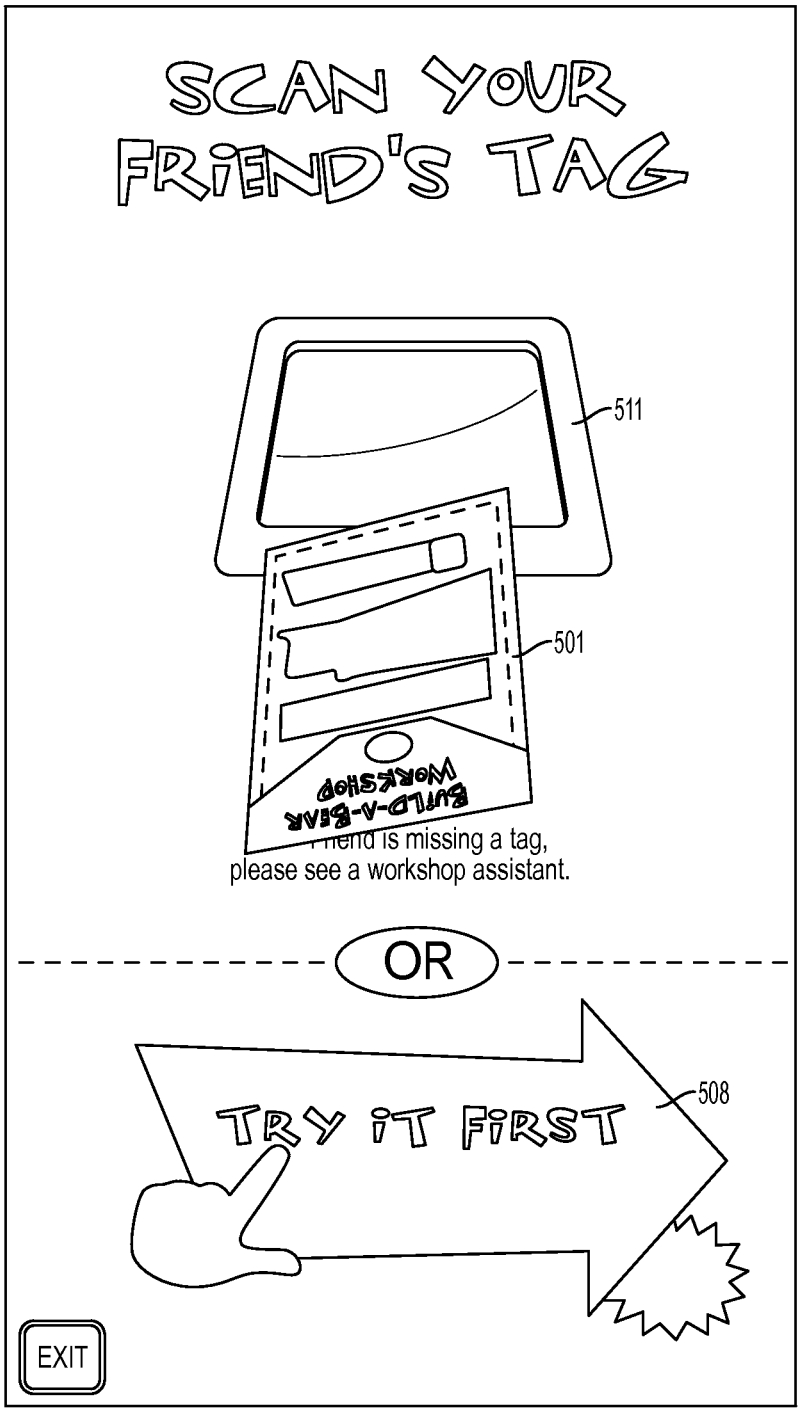

In the event that the kiosk (100) provides for specific toy identification so as to personalize the displays of FIGS. 5-26 to the toy, upon detection of a final consumer the screen (103) will generally change to one such as that shown in FIG. 5A or 5B. The screens of FIGS. 5A and 5B displays a virtual tag (501) of a type which can be attached to the toy so as to show how to identify the toy to the kiosk (100) or may be provided to a particular final consumer (for example, as a frequent purchaser club card). The display also shows an image of the reader (511) which is generally designed to direct the final consumer's attention to reader (111). To increase the attention, an indicator (503) may also be provided. In the depicted embodiment of FIG. 5A, the indicator (503) comprises animated arrows which are pointing to the reader (111) which, as can be seen from FIGS. 1-3, is directly below the screen (103). In FIG. 5B, a skip option (508) is also provided to allow the final consumer to use the kiosk (100) without actually creating anything. The virtual tag (501) may move in an animated fashion to indicate how to correctly scan the tag on the toy.

Figure 6:
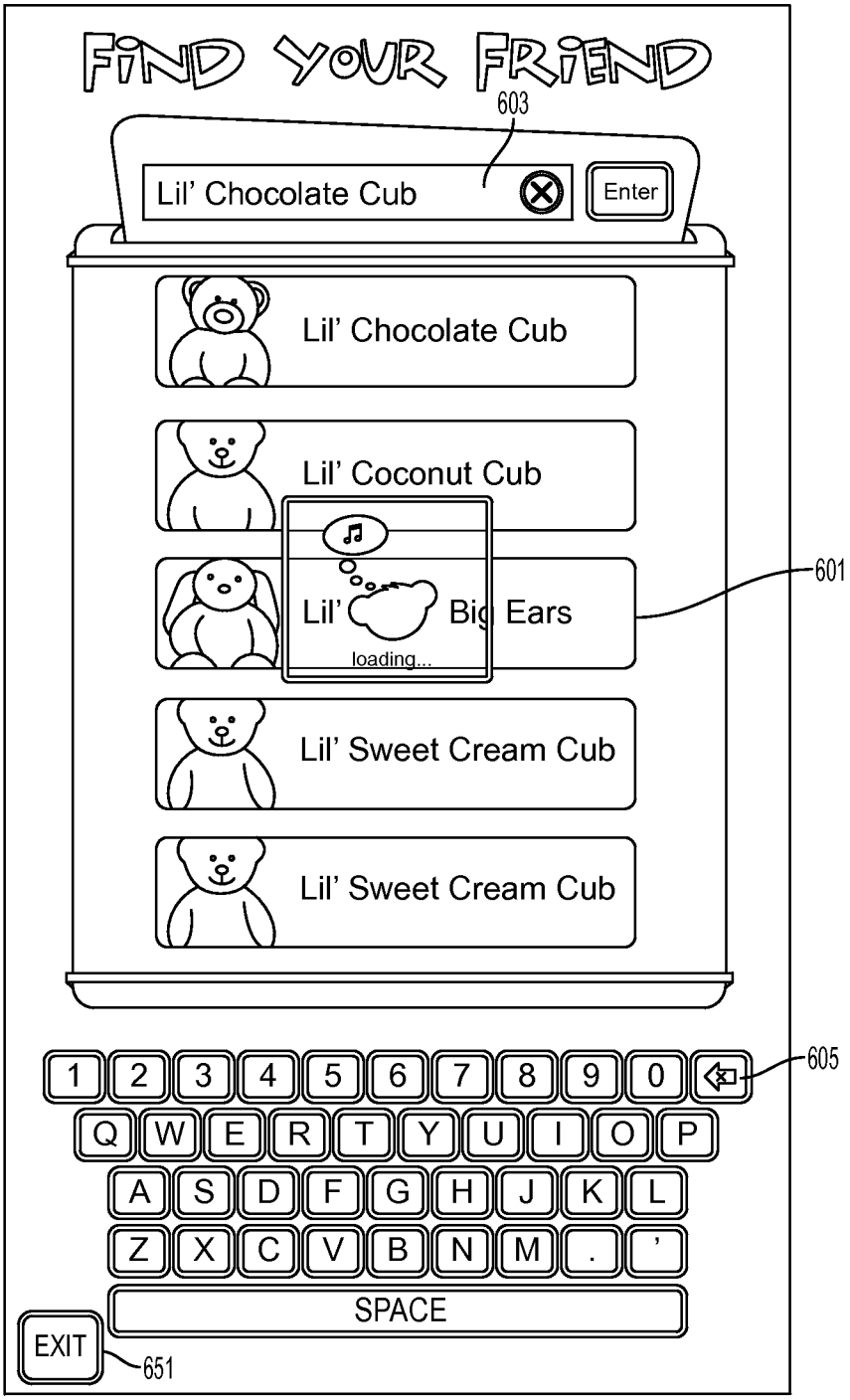

In the event that a tag is not scanned within a predetermined period of time, or the system (10) otherwise determines that a tag is not available or being used by the final consumer, the screen (103) may alter to request a different form of identification of the toy. As the sound is generally to be associated with a specific toy which is undergoing manufacture at the time of the local storage device being recorded in the depicted embodiment, identification of the toy is often desirable. FIG. 6 provides for a listing (601) of available toys that the sound chip may be placed into so that personalization of displays may still be obtained. In order to facilitate interaction, this screen may include search functionality (603) and the ability to enter information (605) in order to facilitate the interaction.

Figure 7:
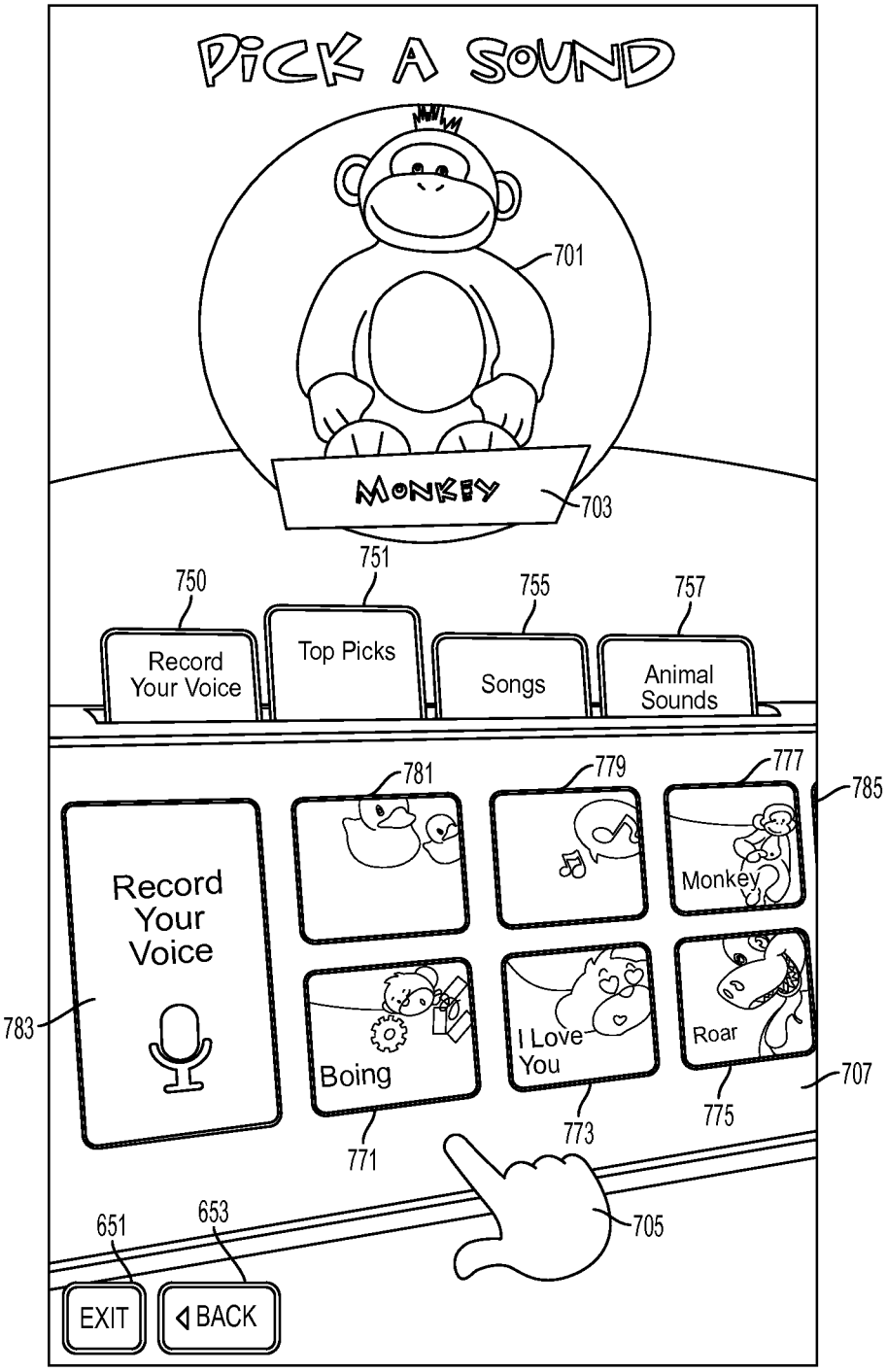
FIGS. 7-10 provide for various screenshots related to an embodiment of software for selecting a sound for placement on a local storage device.

Once the toy has been identified, a completed version of the toy will generally be shown throughout repeated displays so that the sound is associated with the toy throughout the process. This may be the case although the final consumer will generally only have an incomplete toy at this time. Specifically, they are likely to have the outer shell of a plush toy which currently lacks stuffing and internal components. In FIG. 7, the first indication of the identified toy obtained from FIG. 5 or 6 is provided with both a visual depiction (701) and a name (703). In an alternative embodiment, functionality for this identification may not be present or used and in such situation the displays will generally be stock and not include personalization.

FIGS. 7-10 provide for a menu system to allow for a final consumer to select the desired sound to record on the local storage device (109). Specifically, the sounds may be arranged in the form of a digital music player screen as depicted. As the screen (103) in the depicted embodiment is a touch screen interface, a pointer indicator (705) may be provided to facilitate final consumer interaction with the touch screen (103) and to help indicate what a final consumer has selected. The interface with the final consumer can be provided by any touch screen operating system including, without limitation, the Iphone™ operating system (IOS) or Windows™ 7. In an alternative embodiment, a touch may not be required and proximity, eye position, location, or gesture sensing technology (such as, but not limited to, a "heads-up display" of Microsoft Kinect™ controller) and associated devices may be used.

The screen in the depicted embodiment generally comprises a selection of menus of sounds. In FIGS. 7-10, the final consumer is utilizing the "top picks" folder as indicated by raised tab (751). Other folders may be provided based on the sounds available including an option to record your own sound (753), songs (755) and animal sounds (757) or other sound effects.

Regardless of which folder (751), (753), (755), or (757) is selected, the folder will generally display a variety of song indication buttons on a menu (707). In the depicted embodiment, there are more sounds in the selected folder (751) than can be displayed on a single screen (as indicated by partial button (785)), so a final consumer can scroll through them. Each sound is represented by a virtual button. In the depicted screen of FIG. 7, a button is provided from certain effect sounds such as, but not limited to, a "boing" (771), a roar (775), a monkey "ooh-ooh-aah-aah" (777), or a quack (781). There are also buttons for a song (for example, Lullaby by Johannes Brahms (779)) and prerecorded spoken voice (the phrase "I love you" (773)). There is also a button for electing to presently record a custom sound (783).

It should be recognized that the sounds indicated in FIGS. 7-10 are merely exemplary. Any sounds in any combination can be included. A benefit of the system (10) is that since local storage devices (109) are recorded in a self-service, on-demand fashion, the system (10) can include a large number of sounds as the capital cost of an additional sound being present is very low since they are not yet attached to fixed hardware. Thus, while in prior systems sounds had to be selected that were popular and may have to be cycled in or out as popularity waxed or waned, the system (10) discussed herein has no such constraints.

Figure 8:
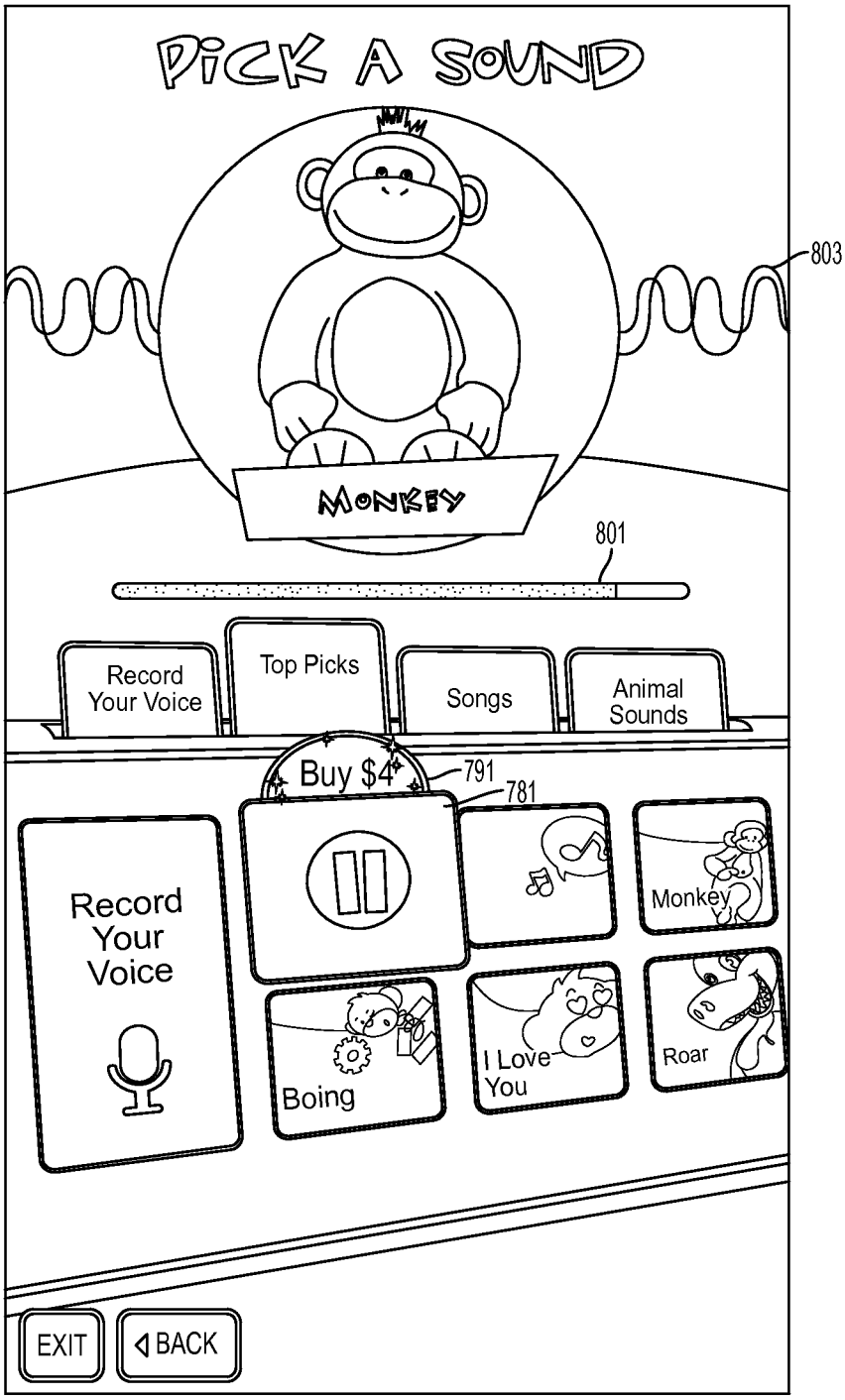
Figure 9:
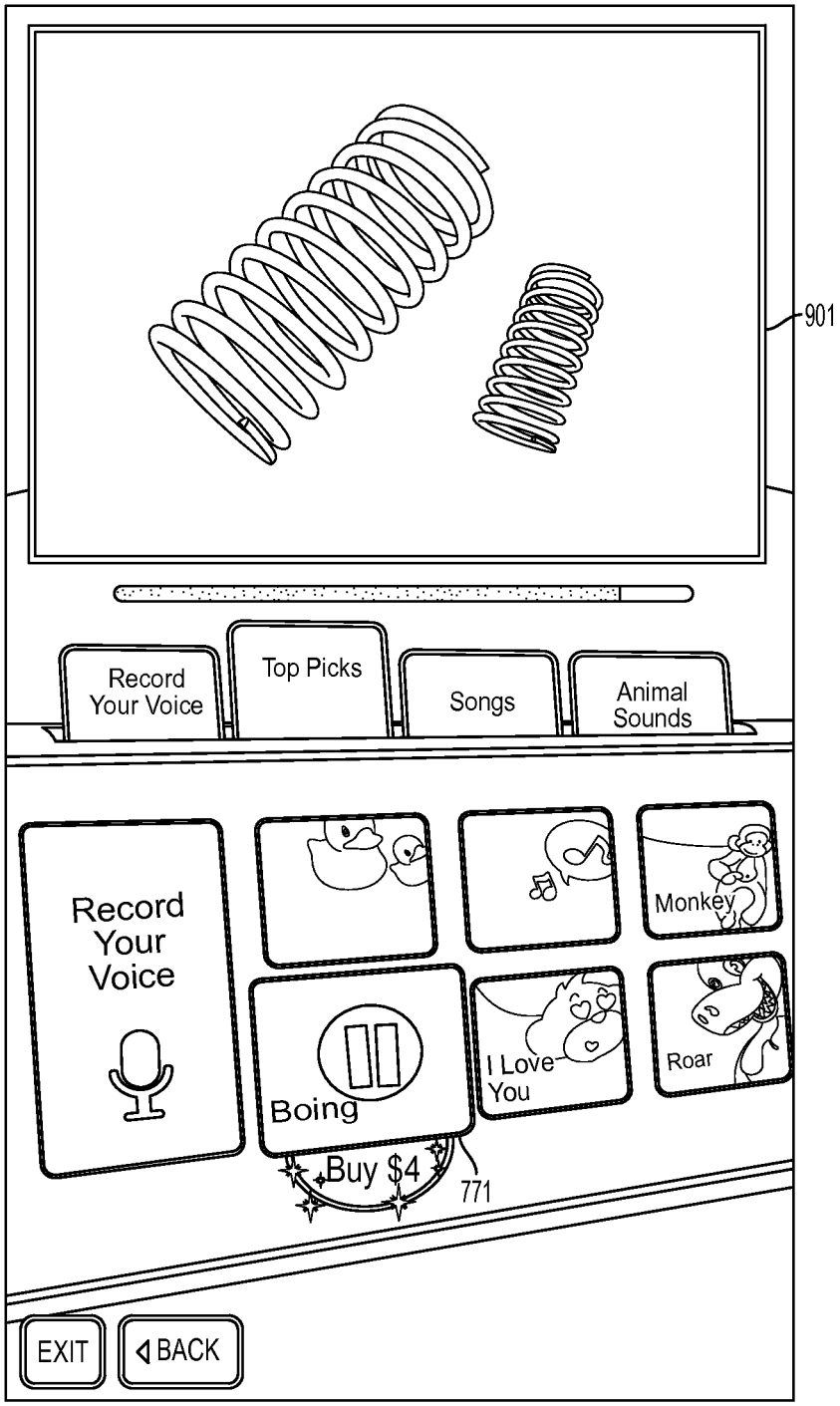
Figure 10:
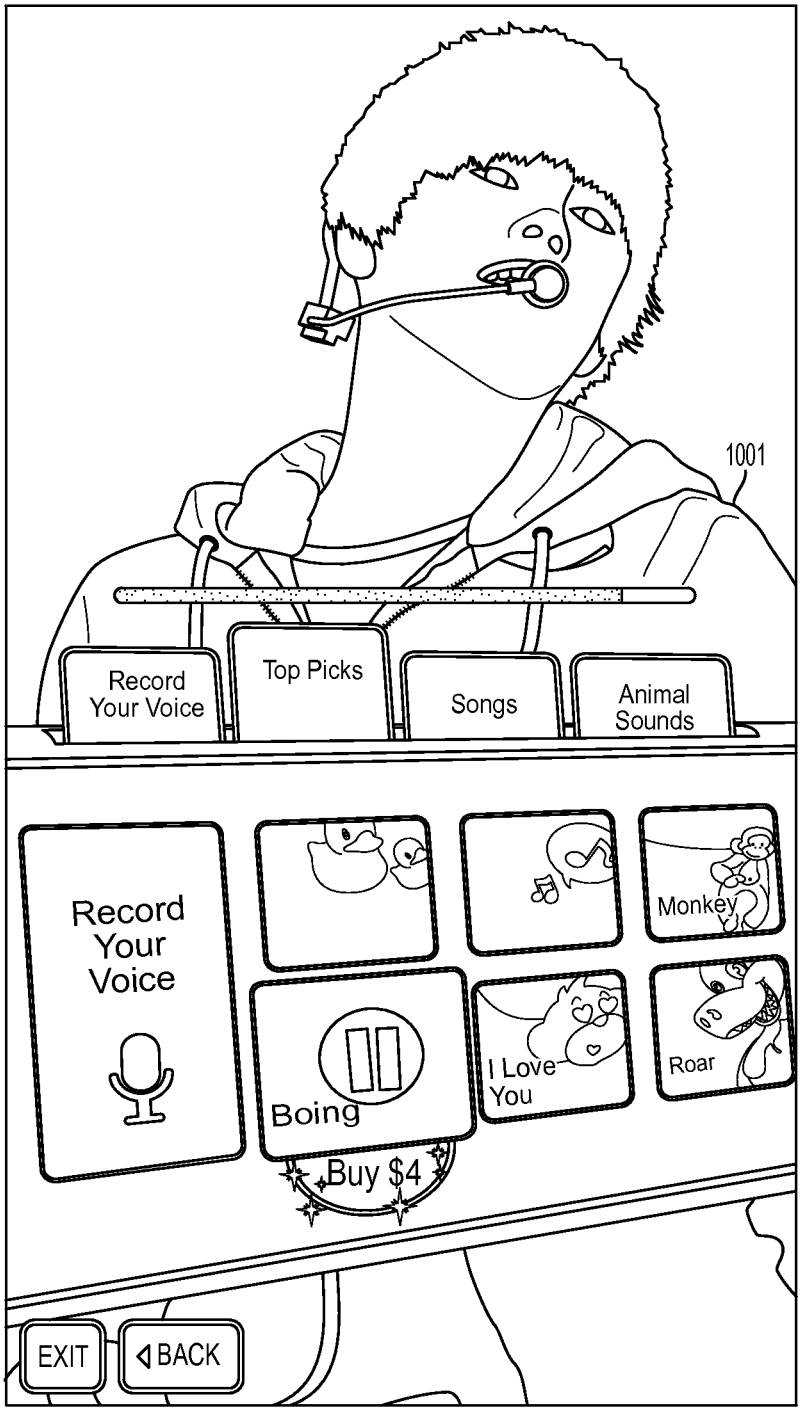

FIG. 8 provides for an indication of when a sound button is touched. In this case, the quack button (781) has been touched. Generally, when the button is touched, the button will highlight to show what button has been touched. The background of the display then changes to show that a sound is playing including having a progression bar (801) and an animated image of a sound wave (803). The sound is then reproduced through speakers (105). This display is merely exemplary of displays which indicate a sound is playing and other displays can be used. In FIG. 9, the display replaces the image (701) and (703) with an image (901) representative of the sound which may be animated with the sound. In FIG. 10, an image associated with the song or music may be provided such as an image of the performer (1001), album art, or a music video associated with the song. The specific image is entirely up to the party programming the kiosk (100).

In the depicted embodiment, indicating the button of a particular sound will also create an interconnected button (791) to purchase the selected sound. In this case, the sounds indicated are each $4 and if the final consumer wishes to purchase the sound and have it recorded onto a local storage device, they would indicate by pressing the interconnected buy button (791). This selects the sound and will begin the process of recording the sound to the local storage device (109) as shown in FIGS. 14-18.

Figure 11:
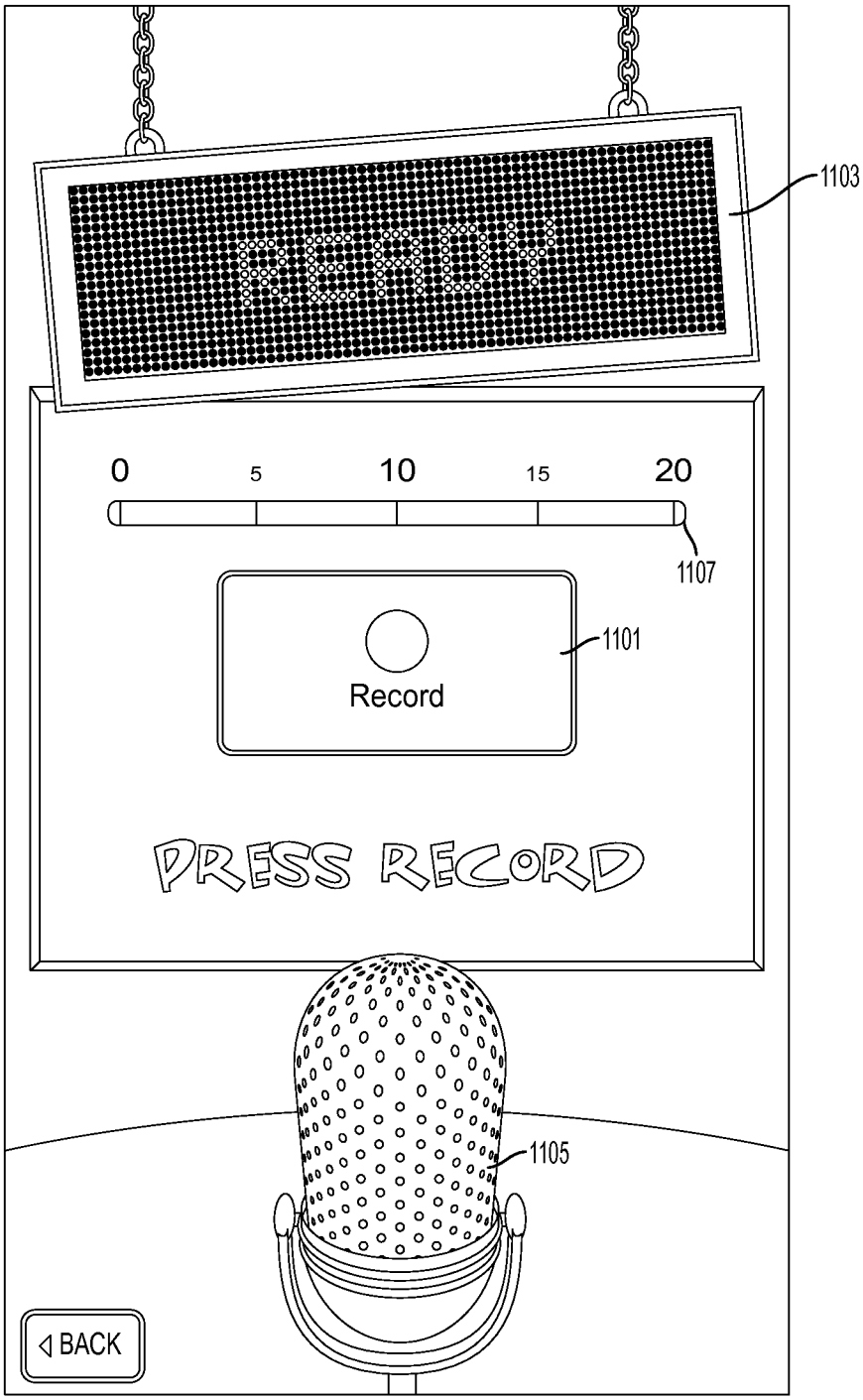
FIGS. 11-13 provide for various screenshots of an embodiment of software for the recording of a completely custom sound for inclusion on the local storage device.
Figure 12:
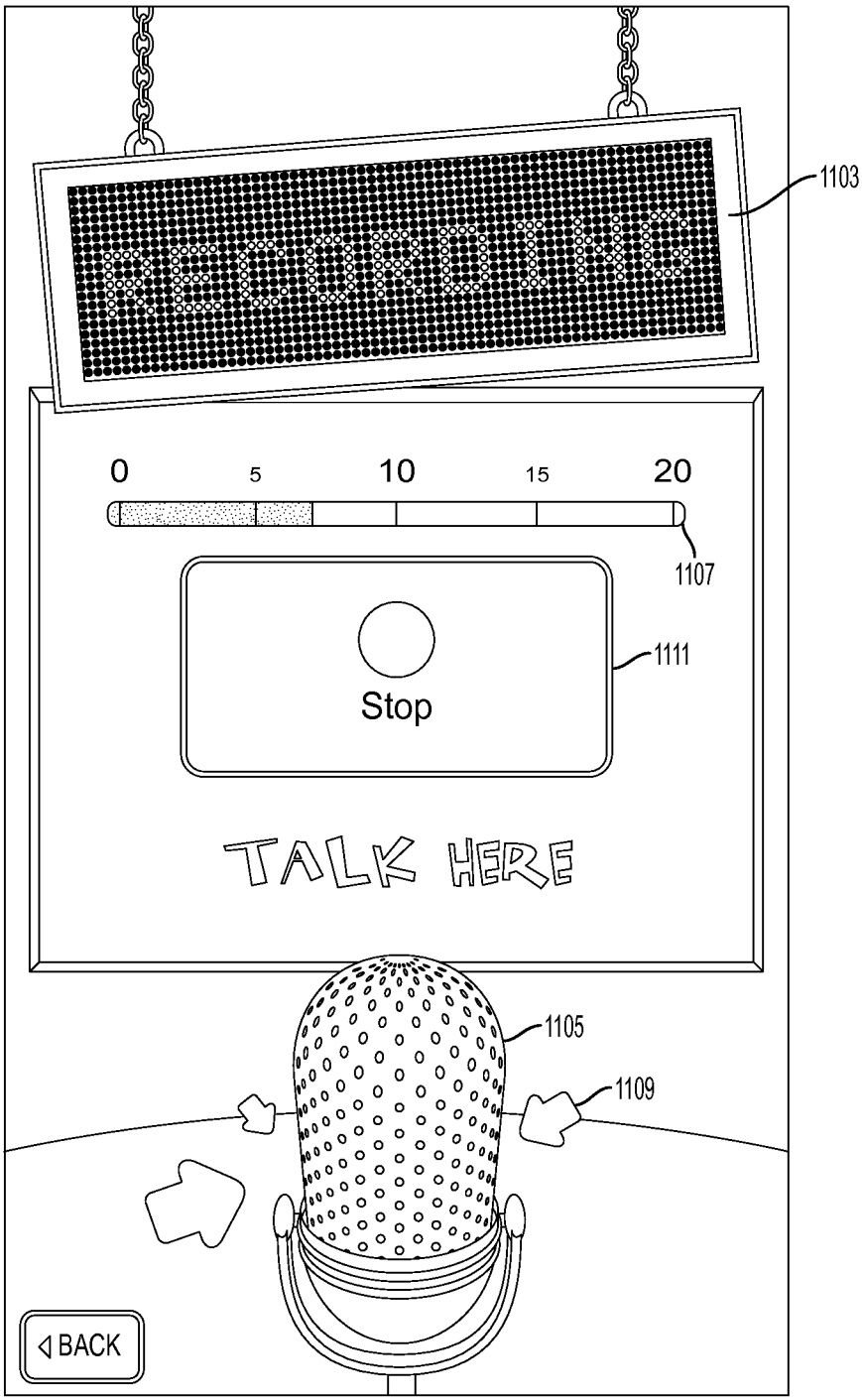
Figure 13:
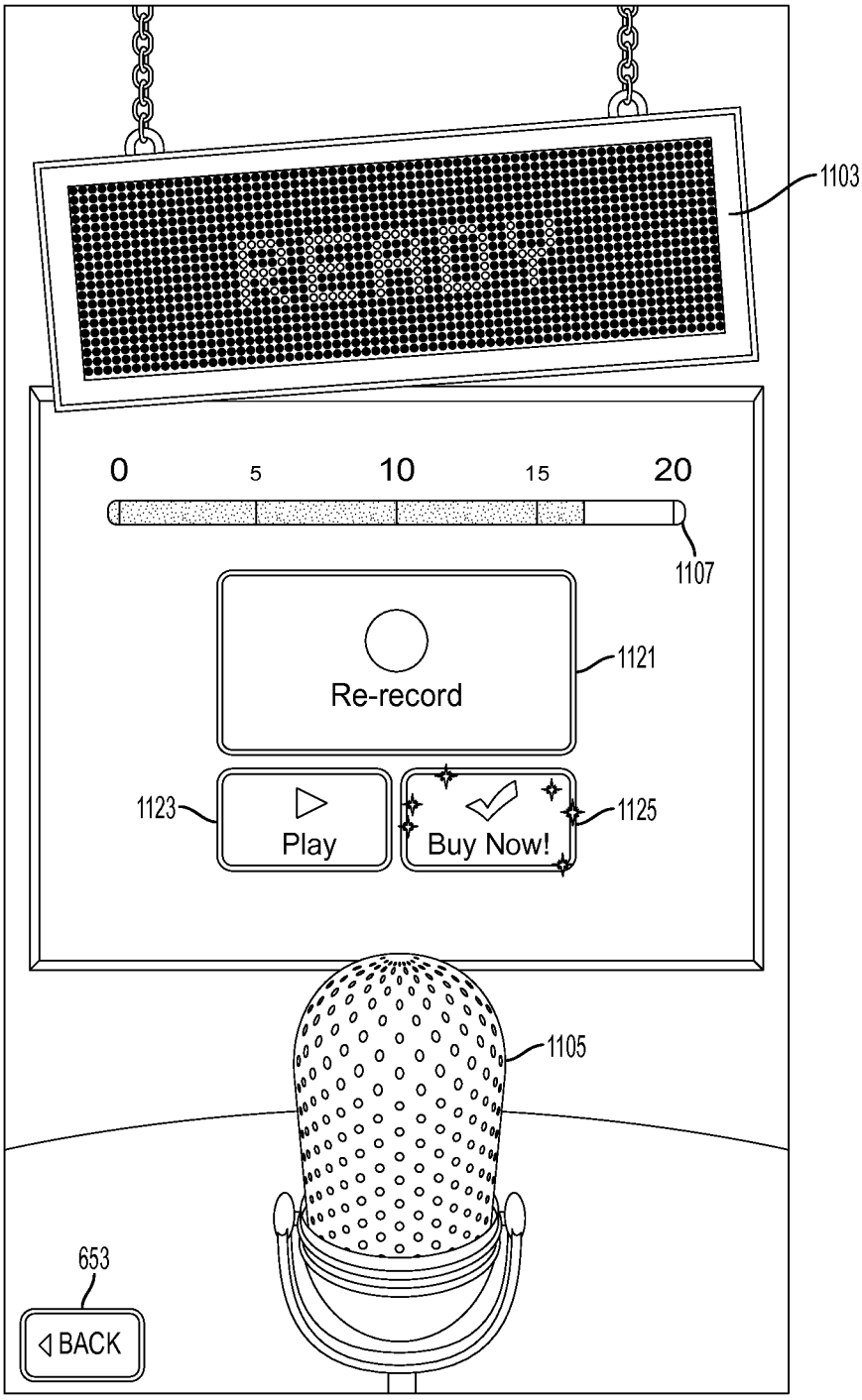

In FIG. 7, there is provided a specific type of sound option which allows for the final consumer to record their own sound. Generally, this would be their spoken voice but could be another sound that they generate. FIG. 11 shows an indication of a screenshot that can be provided to the final consumer when they indicate that they wish to record their own sound. The series of screenshots in FIGS. 11-13 are designed to facilitate the recording of a new custom sound to the system (10) and therefore provides instructions to the final consumer for recording sounds to the system (101).

In FIG. 11, there is provided a button (1101) which is designed to start the recording. This allows the final consumer to control the start of the recording to try and avoid extraneous sounds. There is also a status indicator (1103) showing that the system is ready to record. Basically, the screen of FIG. 11 is designed to indicate that the system (10) is prepared to record a new sound from the final consumer.

In the depicted embodiment of FIG. 11, there is also provided an image of a microphone (1105). In most cases, the actual microphone or other device for recording the sound will not be a part of the display (103). However, such a depiction may be provided to provide an indication to the final consumer of where they should speak to improve the reception of the actual microphone. In the kiosk (100) of FIGS. 1-3, it is generally desirable that the final consumer speak from a position inside the winged sides (141) of the kiosk (100) so that the winged sides (141) can act as a sound break and improve the clarity of the recording. Further, in the kiosk (100) of FIGS. 1-3, the microphone will generally be located toward the bottom of the display (103) and may be designed for optimal recording at a point centered on the lower portion of the display (103). In this case, having the microphone image (1105) provides that the person recording the sound is likely to move toward the image (1105) which places their head more squarely within the wings (141) and can move them closer to the display. If the actual microphone is setup for this being an improved recording position, the system (10) can generally provide for a clearer recording than may otherwise be possible.

In the depicted embodiment, the microphone comprises a dual microphone having a beam forming (or active noise-cancelling) arrangement so as to provide a clear "sweet spot" for recording through constructive interference of sounds at that point and destructive interference for background sounds. The ability to utilize a microphone with a relatively small optimal recording position is generally preferred in the kiosk (100) environment as there is likely extraneous background noise which could cause the recording to be muffled or distorted if the microphone was designed for recording a broad area of sound.

Once the final consumer indicates that they wish to begin recording and touches the record button (1101), the system (10) shifts into the recording mode of FIG. 12. In this mode, a time bar (1107) indicates the remaining available time on the recording and the recording button (1101) has now become a stop recording button (1111) which is touched when the final consumer has completed recording. Input into the microphone would be recorded at this time. Further, to enhance the microphone image (1105) drawing the final consumer into the actual microphone range, it may now be enhanced with animated indicators (1109) to draw further attention. Finally, the status indicator (1103) now shows "recording" to remind the final consumer that sounds are being recorded.

Once the stop button (1111) has been depressed, the system stops recording and goes to the screenshot of FIG. 13. Here the time bar (1108) shows the total length of the recording. The record button (1101) has now been replaced by a rerecord button (1121) which may be used if the final consumer is unhappy with the recording made for any reason. In order to allow the final consumer to fully preview the recording and make sure it is what they want, the final consumer may play the recording (1123) and rerecord it (1121) if they are unhappy or purchase it (1125) if they are happy with it. In order to improve the quality of the recording (1123), the recording (1123) may be processed through software or hardware functions to provide for improved quality. In an embodiment, the microphone may include an automatic gain control to prevent distortion or clipping of the sound as it is recorded. This can allow for a loud sound (e.g., if someone is yelling into the microphone) to be played back clearly and to avoid a quiet sound from being washed out. Similarly, blank (silent) time before, after, or during the recording can be eliminated to make the recording play more efficiently and clearer by eliminating wasted recording space.

In a still further embodiment, the recording may be modified or processed after or during the recording process. For example, the recording may be processed in the manner of an autotuner adjusting the person's voice in accordance with it being tuned to a particular frequency at a particular time. Similarly, other processing, such as, but not limited to, modifying the voice to be squeaky high (e.g., a chipmunk), processing it to sound mechanical (e.g., a robot), or distorting its speed (e.g., as if underwater), can be performed to allow the final consumer to add effects to the recording as they desire.

When the purchase button (1125) is indicated, the system (10) will now proceed to transfer the newly recorded sound from the local memory of the kiosk (100) to a local storage device (109) in the same manner as it is performed for a sound from the library already on the system (10).

It should be apparent in all the screens of FIG. 11-13 that there is a back button (653) which allows the final consumer to exit the specific recording pattern and return to prior screens. This along with exit button (651) (visible in FIGS. 6-10) allows the final consumer to navigate backward if they inadvertently indicate the wrong thing on the screen (103) or change their mind about what they want. They can also exit the entire sound system program (returning to the attract loop) if they determine they are no longer interested in obtaining sound for the toy.

It should be recognized that, in conjunction with the above discussion of FIGS. 8-13, the final consumer is referred to as "purchasing" the sound for the local storage device (109) when they indicate interest on the buttons (1125) or (791). Depending on the embodiment, an indication of purchase may actually be a purchase with a transfer of funds being accomplished at that time, or more commonly would simply be an indication to add the sound to a basket of goods which will be purchased once the toy has been completed. In the depicted embodiment, the action to "buy" the song actually serves as an indicator that the song is placed in a shopping cart on the expectation that the final consumer will incorporate the local storage device (109) into the toy therefore it starts the process of recording the local storage device (109) to be used with the toy.

It should be recognized that a final consumer may record a local storage device (109) and then determine that they do not want it. In the depicted embodiment, in this event the final purchase transaction will often include the cost for the local storage device (109) and sound. However, the process of finalizing the sale can determine that the local storage device (109) has not been included in the toy and the sound item can be retroactively removed from the shopping cart prior to the sale being finalized.

Figure 14:
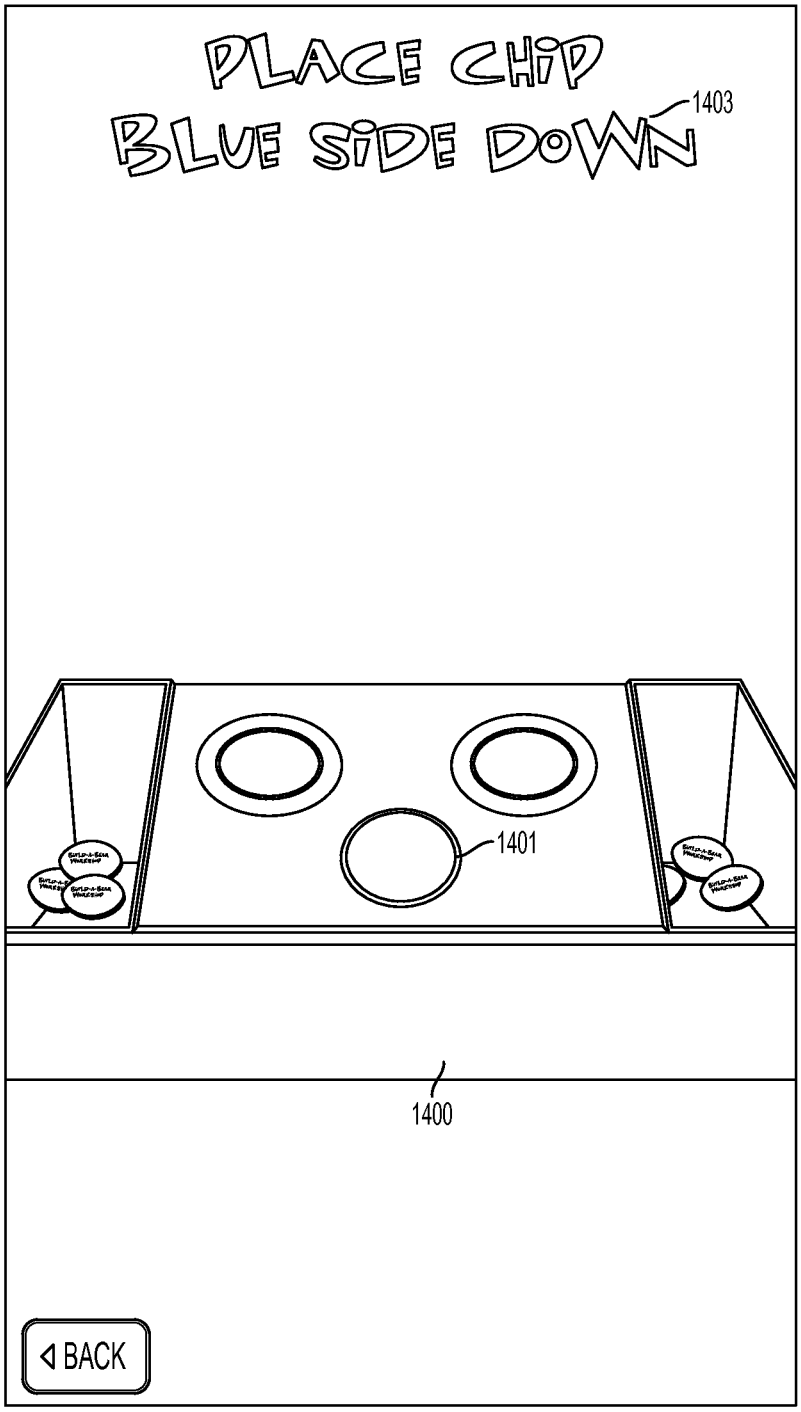
FIGS. 14-16 provides for various screenshots of an embodiment of software for preparing the local storage device to transfer the selected sound from the kiosk.
Figure 15:
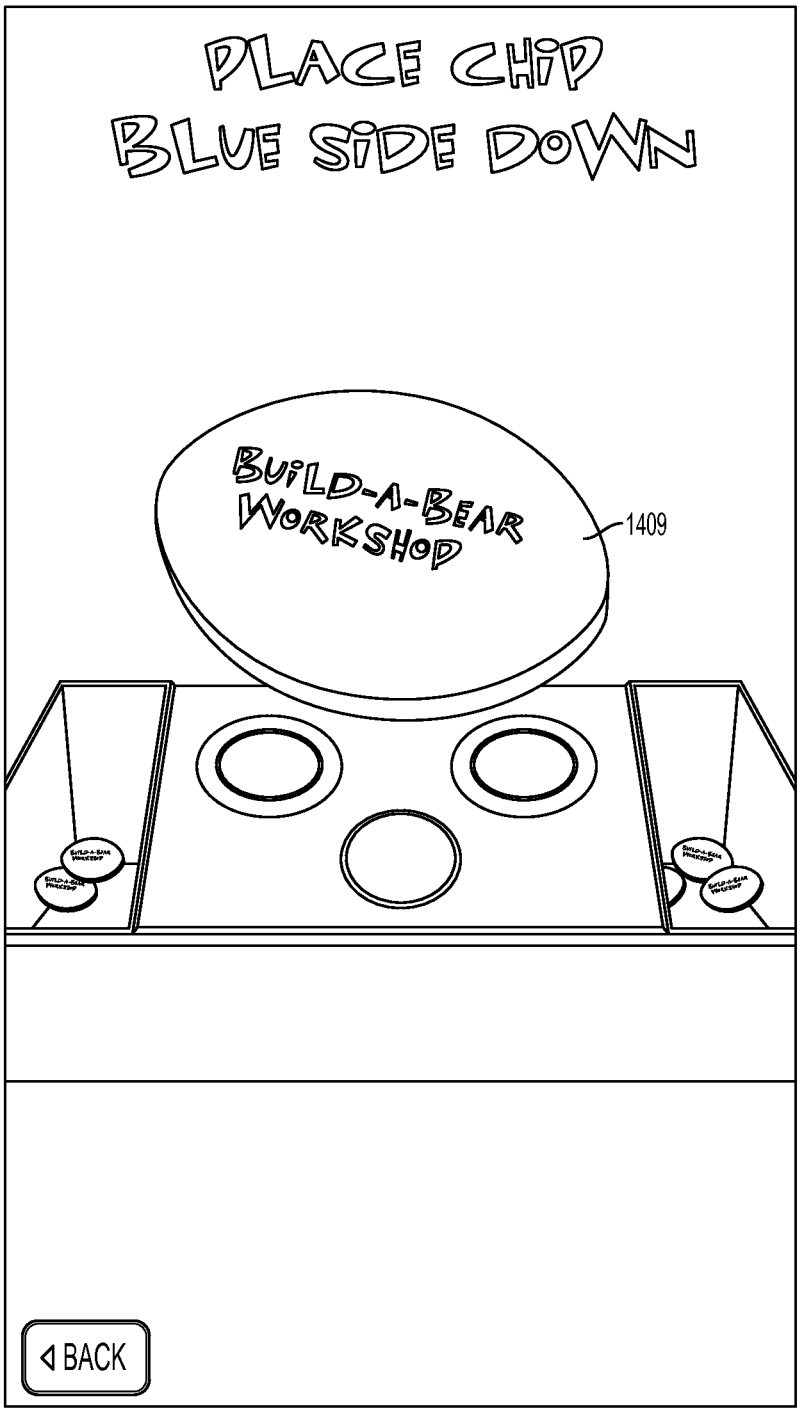
Figure 16:
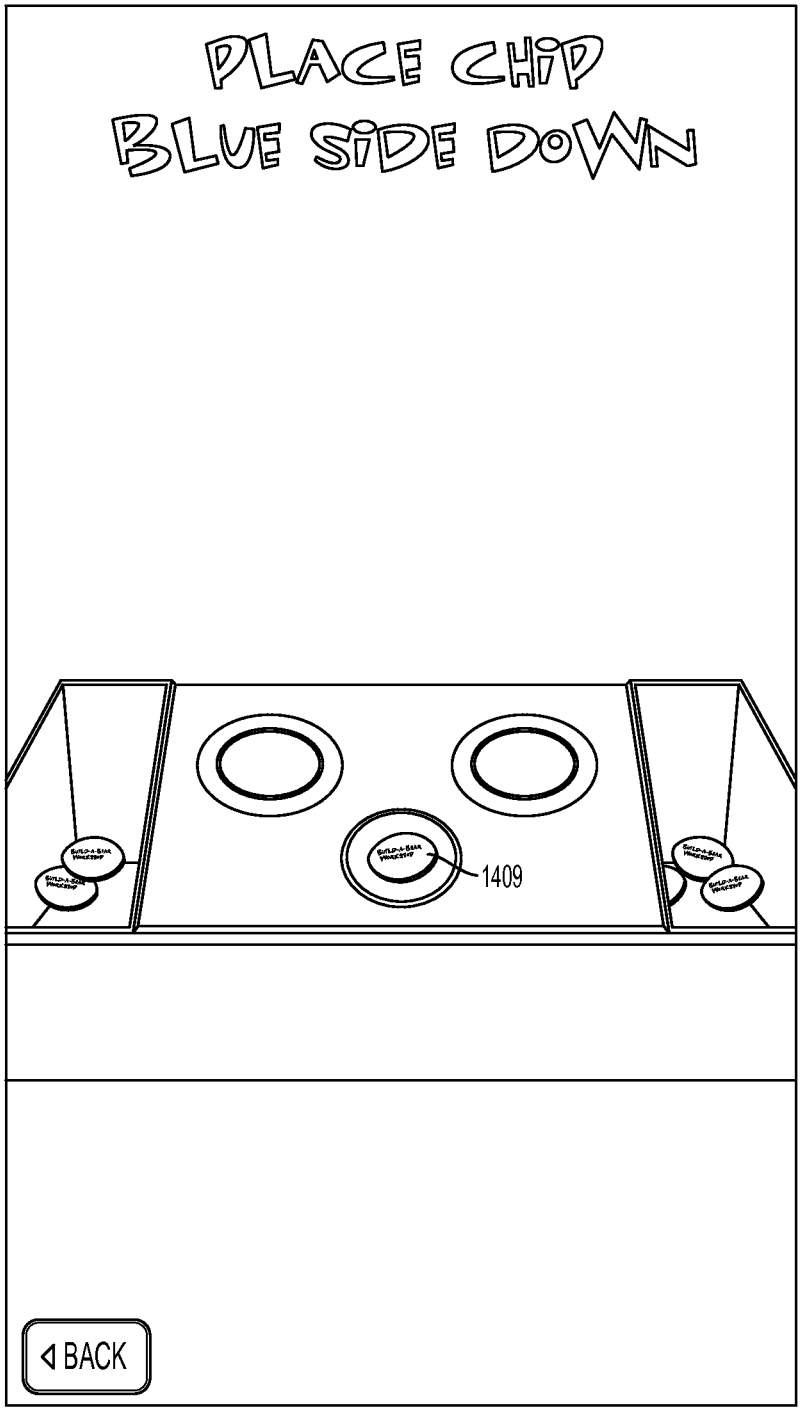

Upon the indication that the final consumer has selected and wishes to purchase a specific sound, the system (10) will generally go into a local storage device (109) recording instruction segment which is shown in FIGS. 14-17. FIGS. 14-16 provide for an animation showing a virtual representation of the kiosk (1400) where the location of the cradle (113), into which the local storage device (109) is placed, is shown highlighted (1401). Textual instructions to place a local storage device (109) are also provided (1403). The animation then shows a virtual local storage device (1409) in FIG. 15 moving to the correct position of FIG. 16 to assist the final consumer in correctly placing a local storage device (109) from the bins (107) in the correct location for recording.

Generally, the system (10) will be able to automatically detect that a local storage device (109) has been correctly placed and, once it has so determined, it will initiate the transfer of the sound data onto the memory of the local storage device (109). This automatic detection may occur using any methodology such as optical detection, sonic detection, or other technologies. In the depicted embodiment, the local storage device (109) will be detected by its alteration of a magnetic field in the cradle (113) such as, but not limited to, by the local storage device (109) including metallic components which interface with a metallic field in the cradle (113) or by the local storage device (109) including a permanent magnet where the cradle (113) can detect the field and polarity to determine not just location of the local storage device (109) but orientation.

Figure 17:
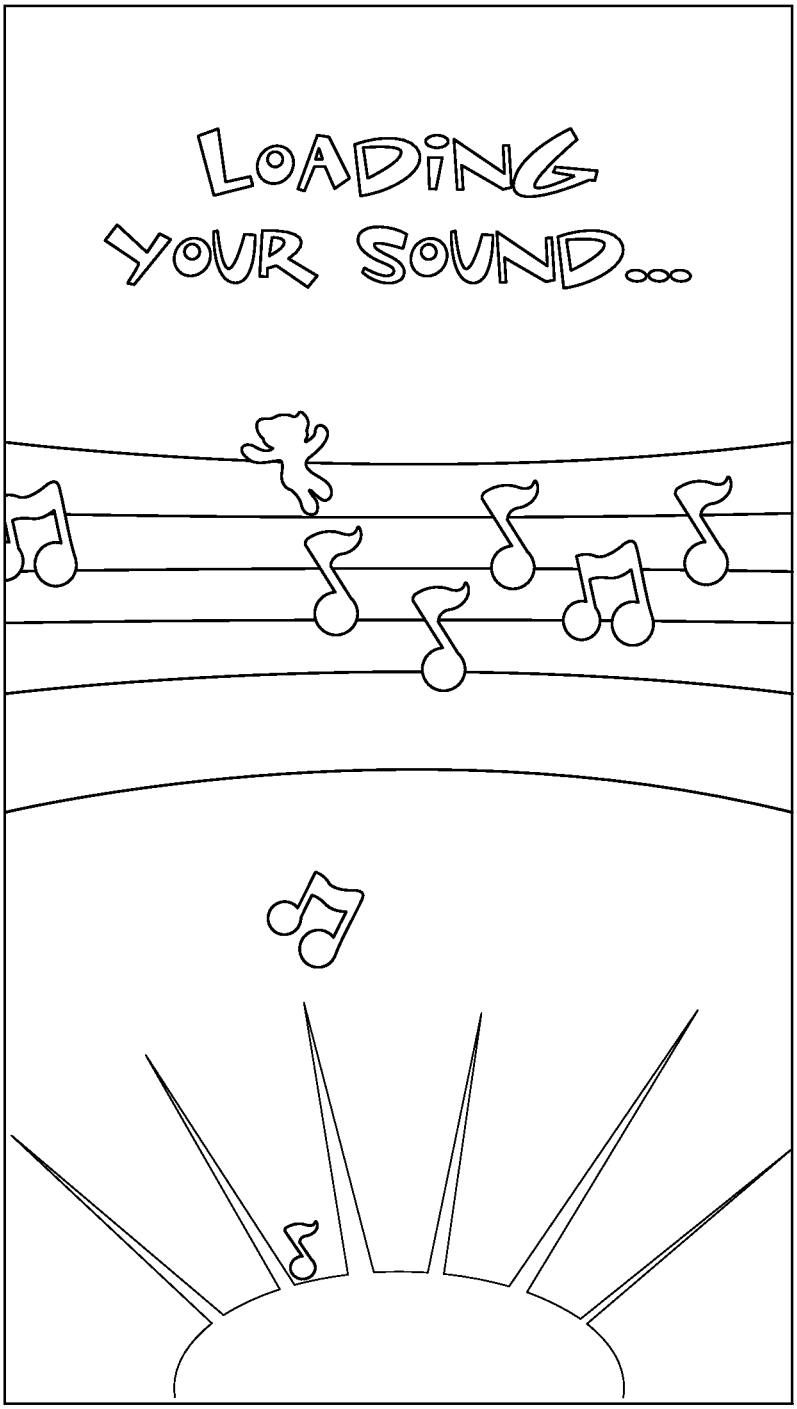
FIG. 17 shows a screenshot of an embodiment of software for a hold screen while the local storage device is programming.

As recording of the local storage device (109) will generally take some time, a wait screen (1701) as shown in FIG. 17 can be provided to show that the action is progressing. Similarly, completion bars or indicators (such as by slowly illuminating the light ring (131) on the cradle (113)) may also be used to indicate progress.

Figure 18A:
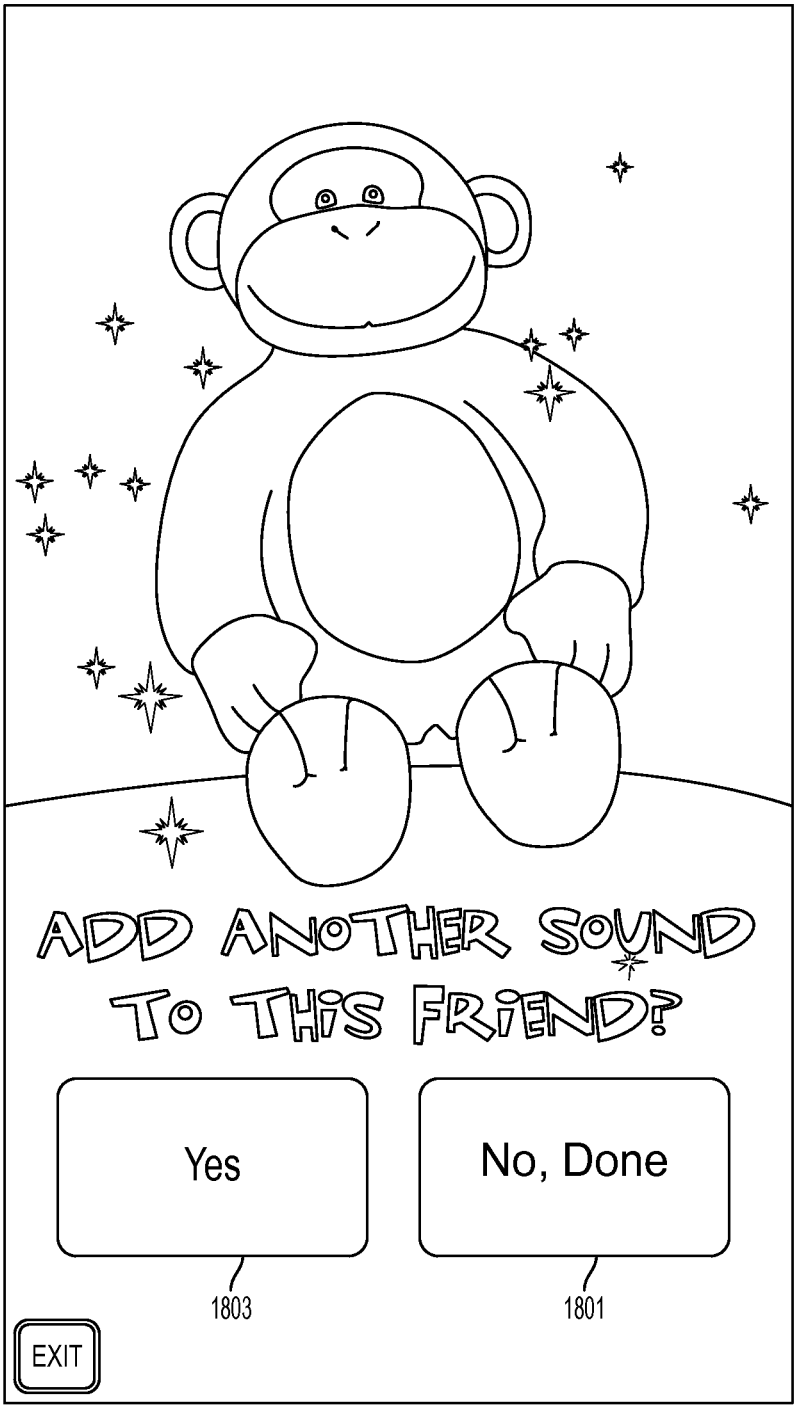
FIGS. 18A and 18B shows a screenshot of an embodiment of software for completion of the sound recording process.
Figure 18B:
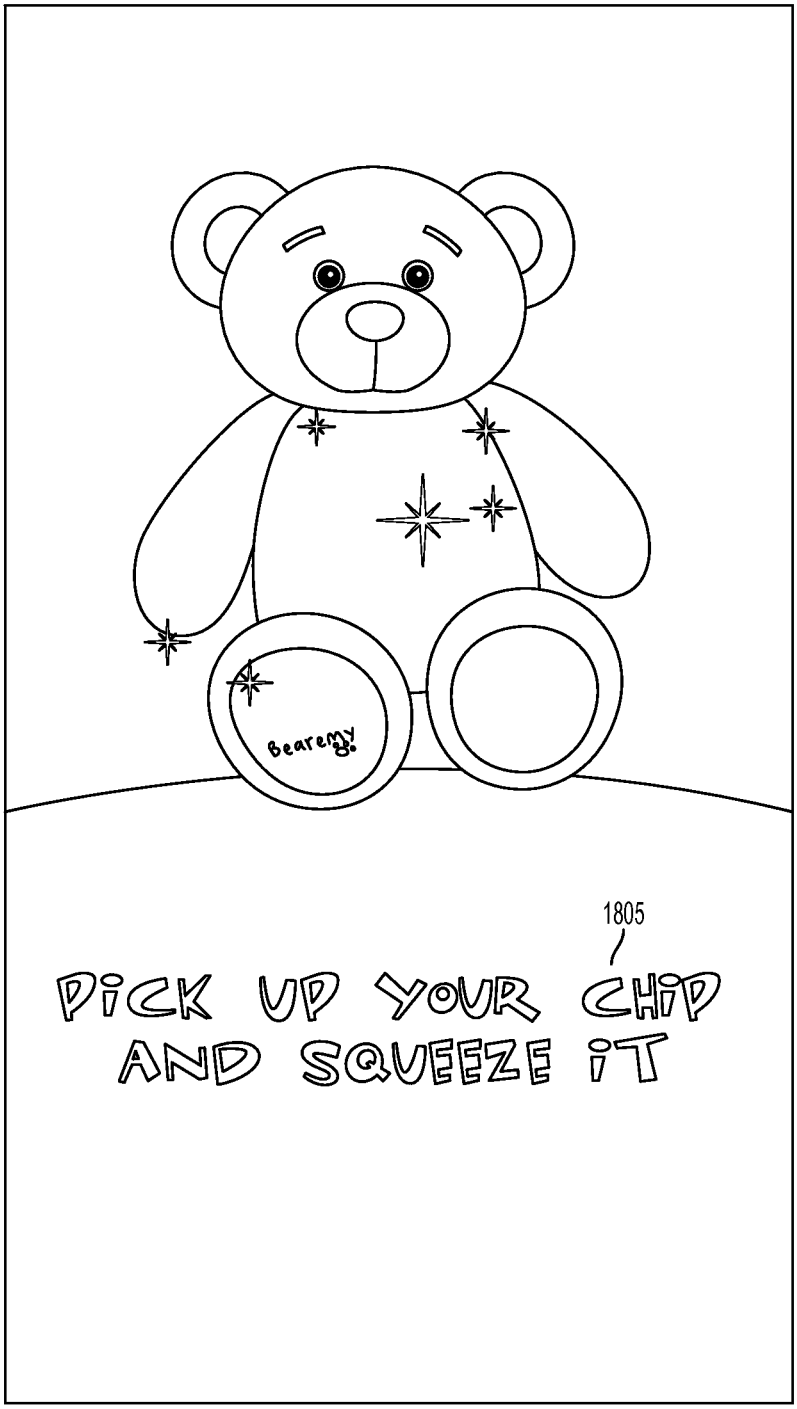

Once the local storage device (109) has had the selected sound transferred to local memory, the screen (103) will generally change to that of FIG. 18A to indicate the sound has been recorded and will ask the final consumer if they are done (1801) or wish to record another sound (1803). Alternatively or additionally, FIG. 18B may be used to suggest (1805) to the final consumer that they test their local storage device to make sure the sound recording is accurate. In an embodiment of the system (10), each local storage device (109) is designed to only hold a single sound (although it may have more memory than needed and could potentially include additional sounds or data) and, therefore, if the final consumer wishes to record an additional sound they would repeat the process of FIGS. 8-17 with another new local storage device (109) being placed in the cradle (113) prior to activation of the transfer sequence. Each of the plurality of local storage devices (109) so recorded can then be placed within the toy. For example, when the toy is generally in the form of a plush animal, one local storage device (109) may be placed in any or all appendages (arms and legs) and/or provided in a number of different accessories to provide for multiple sound options.

In an alternative embodiment, the local storage device (109) may be able to record a plurality of different sounds and may play them in a pattern, by random selection, or by another methodology as known to one of ordinary skill. In this case, the election to record another sound can cue the system (10) to not record over sounds already on the local storage device (109) in the cradle (113) but instead to add to them and the screens may provide specific indications to leave the local storage device (109) in the cradle (113).

In a still further embodiment, the local storage device (109) and system (10) could be capable of recording multi-track sound. Specifically, a final consumer's sound into the microphone could be combined with a background track (such as music or sound effects) which do not comprise separate sounds, but instead comprise a singular sound with multiple overlapping tracks. Alternatively, the sounds could all be selected from multiple microphone tracks or from multiple provided recordings. In a still further embodiment, sounds can be both combined and provided separately on the same local storage device (109) or could be mixed by the system (10) to provide for a much longer "sample mash-up" type track.

In yet another embodiment, a custom sound track can be generated for each final consumer. This sound could be generated by the system (10) instantaneously (e.g., by digitizing notes based on a final consumer input), or could be a random sampling of a variety of sounds which are combined. For example, if the toy provided was a dog, the system (10) could generate a sound file with various different dog sounds (such as bark, whining, running, etc.) in a random order and mix, or according to a predetermined algorithm. In this way, the sound file could be unique and personalized to each final consumer, while still comprising a relatively small number of preset components. Such customization could be attached to the type of animal identified when the toy is identified by the system (10) as discussed above.

Custom sounds can also be generated by a "fill-in-the-blanks" or "mad-lib" type process. In this, a final consumer would be asked to fill in certain blanks by speaking into the microphone, with these short recordings becoming a part of a larger sound. This can be used to provide an individual with a more eloquent speech than they may otherwise be able to develop on their own, can allow them to alter song lyrics for their own effect, or could allow them to even develop their own sound effect track, among other things.

In a still further embodiment, the local storage device (109) may be designed to only have a single recording placed thereon. However, the selection screens of FIGS. 7-10 may allow the final consumer to select multiple sounds to be recorded together in a single recording step or may provide for a preselected plurality of sounds provided together. For example, there may be a sound button for a single sound where the sound comprises a plurality of pregrouped sounds such as, but not limited to, excerpts from a plurality of songs by the same artist. This can be selected as a multiple sound "pack" although the selection process is essentially the same as when a single sound is selected. This is not the same as the multi-track recording contemplated above (where the sounds are placed on top of each other) but allows for multiple tracks to be placed sequentially. Alternatively or additionally, the final consumer may be able to create their own "pack" of sounds from available sounds generating a single download once all desired sounds are selected and carrying out a single step of transfer for all sounds to the local storage device (109).

Once the final consumer has completed all transfers of sounds to local storage devices (109) they intend to record, the final consumer will generally be done with recordation of sounds and will leave the kiosk (100) to continue with the toy manufacturing process or to otherwise move on. In an embodiment, the sound could also be provided to the final consumer in another format. For example, it could be provided to them for use as a ring tone or an another form of recordable media to use for other purposes. Generally, a later stage of the process specifically involves installing the local storage device (109) which has content thereon into the toy. In the event that the local storage device (109) is still separate from the toy once transfer of sound is complete (as is the case in the depicted embodiment), the final consumer will generally take the local storage device (109) from the cradle (113) and carry the local storage device (109) with them to be combined with the toy (generally by the local storage device (109) being placed within the toy's outer shell) at a later stage of the manufacturing process.

In an alternative embodiment, it is possible that the local storage device (109) is already a part of the toy at the time the recording kiosk (100) is activated. This situation may occur at a kiosk (100) as part of the toy manufacturing process (such as in the situation where the toy automatically includes a blank local storage device (109)), at a kiosk (100) to allow later customization of the toy once manufacturing is complete, or through a home recording system provided to the final consumer for their personal use. Regardless of the type of transfer process used, the transfer process may generally proceed in the same way as discussed above. However, instead of placing the local storage device (109) in the cradle (113) exterior to the toy, the toy itself (or a part thereof) may be placed in the appropriate cradle (113) to allow the local storage device in that part of the toy to be recorded.

For example, if the toy already has the local storage device (109) sewn into an appendage, the appendage with the local storage device (109) may be positioned in the cradle (113) to rerecord or record a new sound. In an embodiment, the cradle (113) can be redesigned to better hold such an appendage if this methodology is expected. In this way the toy is not only initially customizable with sound, but the sound or sounds on the local storage device (109) may be altered or rerecorded at a later date.

Further, while the above contemplates the local storage device (109) being a part of the toy, it should be recognized, especially with plush toys, that the local storage device could still be considered part of the toy by being part of an accessory. That is, the local storage device may be included in another toy with which the plush toy is intended to interact (for example, a toy cell phone, or a piece of toy furniture). This would still be considered a part of the "toy" as contemplated by the present embodiment as these would be considered parts of the same toy. In an embodiment, multiple toys could also include local storage devices and operate together.

As discussed above, it is contemplated that the kiosk (100) will generally be final consumer accessible and can be used in an on-demand user controlled toy manufacturing process or as part of the purchase of a toy. Due to the final consumer having control of the kiosk (100), and to simplify operational requirements for employees working with it, it is generally desired that the kiosk (100) include various administrative functions but that such administrative functions be generally hidden from view during standard operation.

The kiosk (100) and system (10) will generally include an onboard computer including memory and a processor. The computer will also generally include computer executable instructions stored in the memory for operating the various components of the kiosk (100) including instructions for generating the various displays on the touch screen (103), for taking in input from the touch screen (103), for storing and retrieving sounds, and for transferring the sounds to the local storage devices (109). The computer is generally enclosed within the housing (101) and is generally not readily accessible without a key or similar access control device. The computer may include a power cable and/or wired connection for connecting with power of network infrastructure in an embodiment. The computer in the kiosk (100) will generally act as a client computer in a network such as, but not limited to, the Internet. It will therefore include some form of connection (whether wired or wireless) to a remote server computer and often a remote memory as is well understood by those of ordinary skill the art.

In the networked computer implementation, the ability to provide for ready access to a large library of sounds is available. Specifically, the onboard client computer can access a remote server and may download from the remote server any or all sounds from a central repository of digital files of such sounds. This update may be performed on a schedule or on demand, or both. By having sounds stored remotely and downloaded to the client as appropriate, the kiosk (100) can be quickly adapted to include new sounds. In addition, particularly popular sounds can be stored in a local kiosk memory to provide faster loading and transfer to local storage devices (109) while less commonly purchased sounds may be available via the network from the remote memory so a final consumer who specifically wants them can obtain them, even if the transaction to obtain them takes a little longer.

In this way, the kiosk (100) has access to a library of vastly more available sounds than a display with prerecorded stocked chips ever could. Further, as many sounds (such as particular recording of popular music) require reproduction licenses to be recorded onto local storage devices (109), the networked system can also provide a single point of entry when a new sound becomes licensed and as a clearinghouse to determine total sound purchase and payment of appropriate licensing fees back to the owner of the sound. Still further, as the system can obtain new sounds quickly, date specific sounds (such as a current newspaper headline) could be made available.

Still further, allowing access to a networked library of sounds can provide for additional functionality with final consumer generated sounds. In an embodiment, final consumer generated recordings can be stored in the library. This may be done generally, or may be performed in association with the particular toy or final consumer which they are associated. Such a library can allow for remote recording of sounds. For example, a final consumer's relative could record a sound at home (e.g., through a networked environment associated with the toy or through a smartphone "app" which is provided for that particular purpose) which the final consumer could access from the library at the kiosk (100) and record onto a local storage device (109) at the kiosk (100).

An advantage of the network arrangement is that it is unnecessary for the final consumer to have access to the recording (even if they made it) or bring the recording with them. It may be accessed by the toy's identification, or may be accessed by a machine readable indicia (e.g., bar code or QR code) or password that the final consumer has with them. Similarly, should a sound be recorded in the library and the local storage device (109) wear out or if there is a need for duplicates of the sound in another toy, the toy may be brought back to the store and the archived sound could be retrieved for placement on a new local storage device for placement in the toy or another toy. As personalized sounds may be recorded by individuals who are no longer available for rerecording, this can provide for the ability to archive irreplaceable recordings.

In addition to final consumer controls and backend computer functionality which serves to operate the system, the kiosk (100) and computer may also provide various administrator functions. Access to administrator functions may be through a hidden button (on the touch screen or elsewhere on the kiosk (100)) which a final consumer would not generally know is accessible. Some administrative functions are shown in the screenshots of FIGS. 19-26. However, other administrative functions such as, but not limited to, carrying out an on-demand update of sounds in local memory, rebooting a crashed system, or altering screens provided to the final consumer, can also be provided as is understood by one of ordinary skill in the art.

Figure 19:
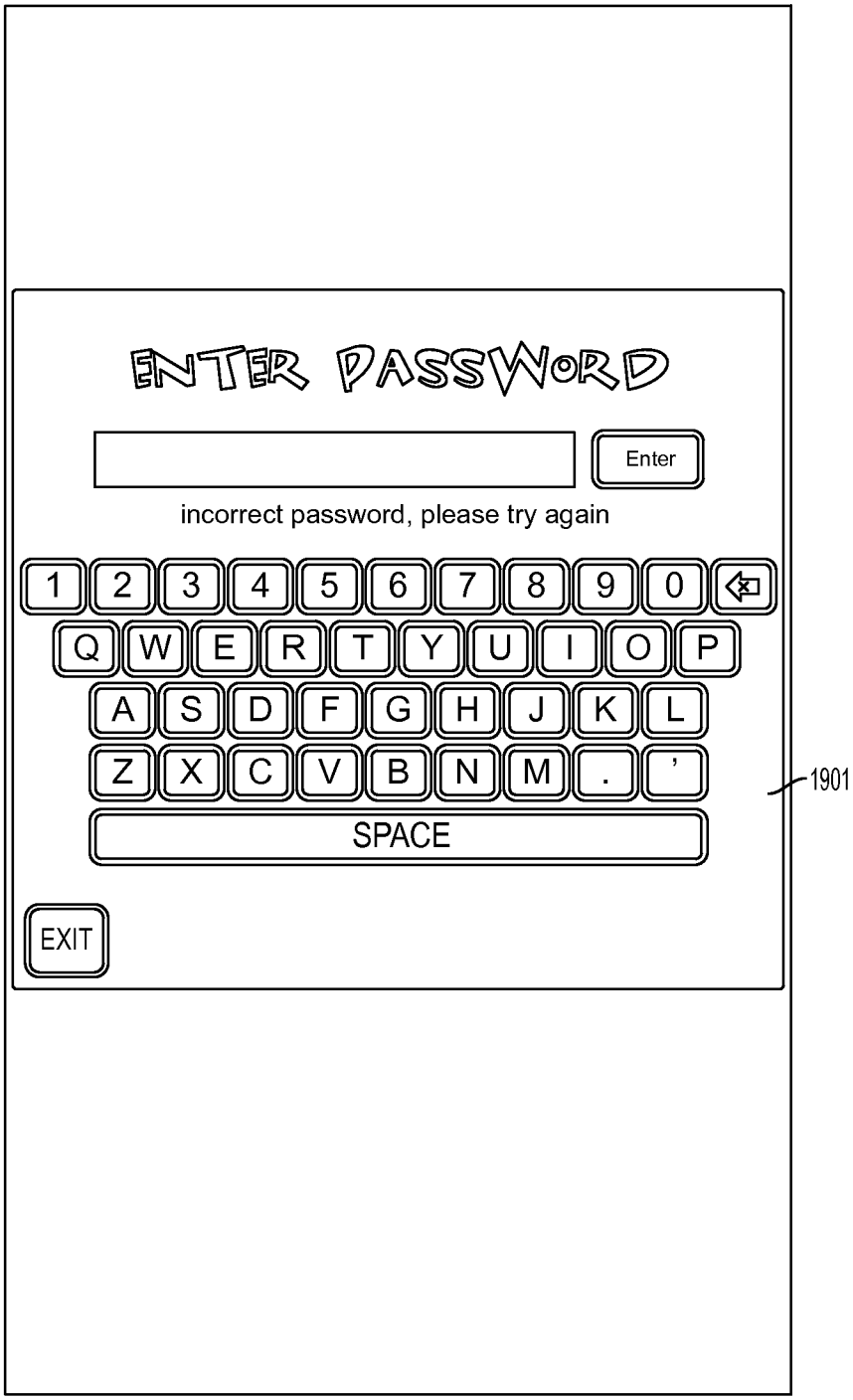
FIGS. 19-20 shows screenshots of an embodiment of software for administrative control of a kiosk to perform functions not generally provided to the final consumer via the kiosk's self-service point-of-sale functionality.

In the screenshot of FIG. 19, there is shown an administrative access panel (1901) that, when administrative access is requested (the hidden button is activated), provides a password or similar request to verify the identity of the current user as one having administrative access. This administrative user may be, but is not limited to, an employee of the store where the kiosk (100) is provided. This type of authentication system is preferred, but not required, so that a non-administrative user does not inadvertently access administrator functions and to inhibit malicious attempts to access administrator functions.

Figure 20:
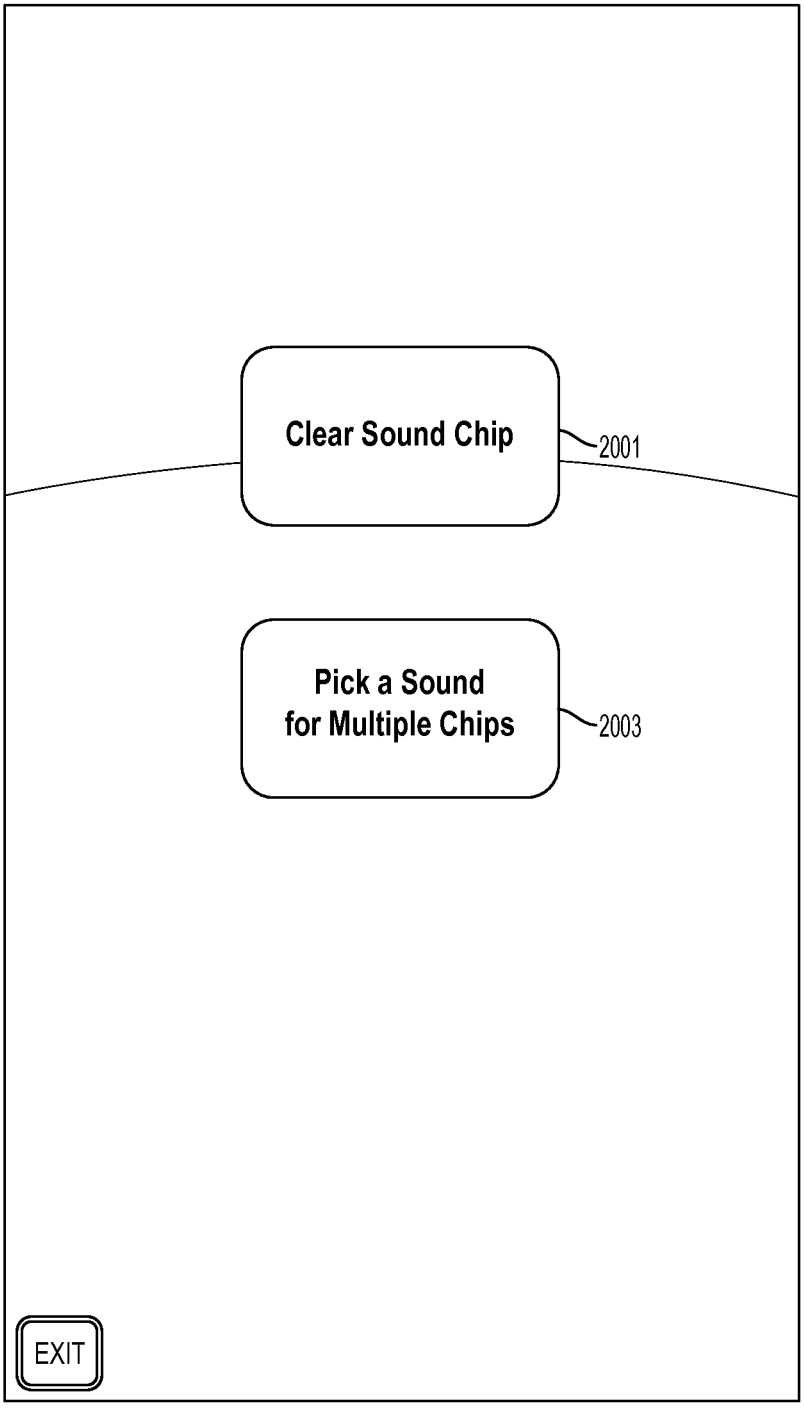

In FIG. 20, there are provided two administrator functions. The first function (2001) allows the administrative user to purposefully erase local storage devices (109) that have been previously recorded (as opposed to simply having final consumers record over them over time), while the second function allows for an administrative user to record a plurality of local storage devices (109) with the same sound in an expedited manner. In alternative embodiments, more or additional administrator functions can be provided including, without limitation, specific settings for parties, features for transferring sounds between local storage device (109) or reading them into the system (10) from a local storage device (109), and settings for custom programming of the kiosk (100) or system (10).

Figure 21:
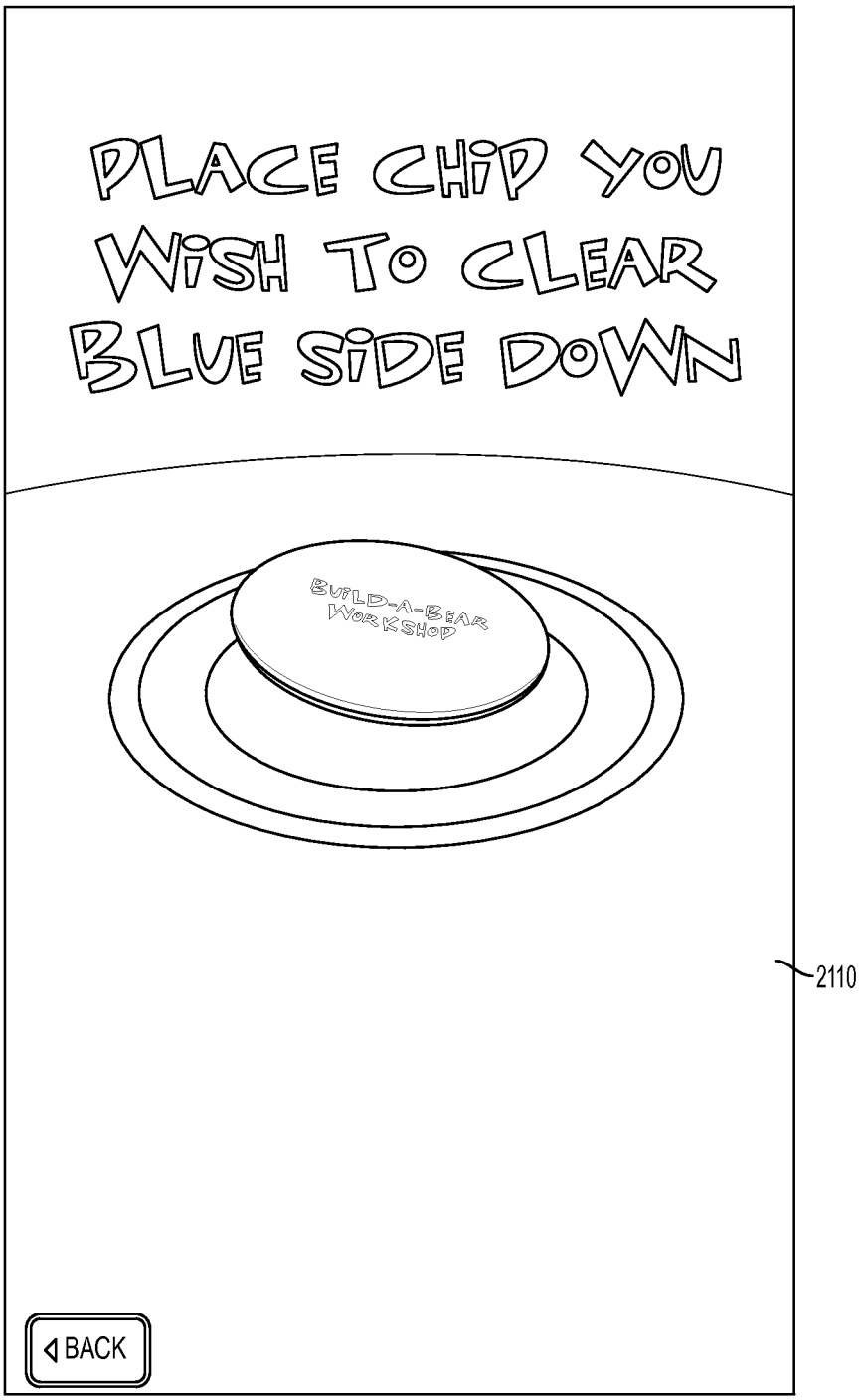
FIGS. 21-23 provide for screenshots of an embodiment of software for administrative clearing of local storage devices.
Figure 22:
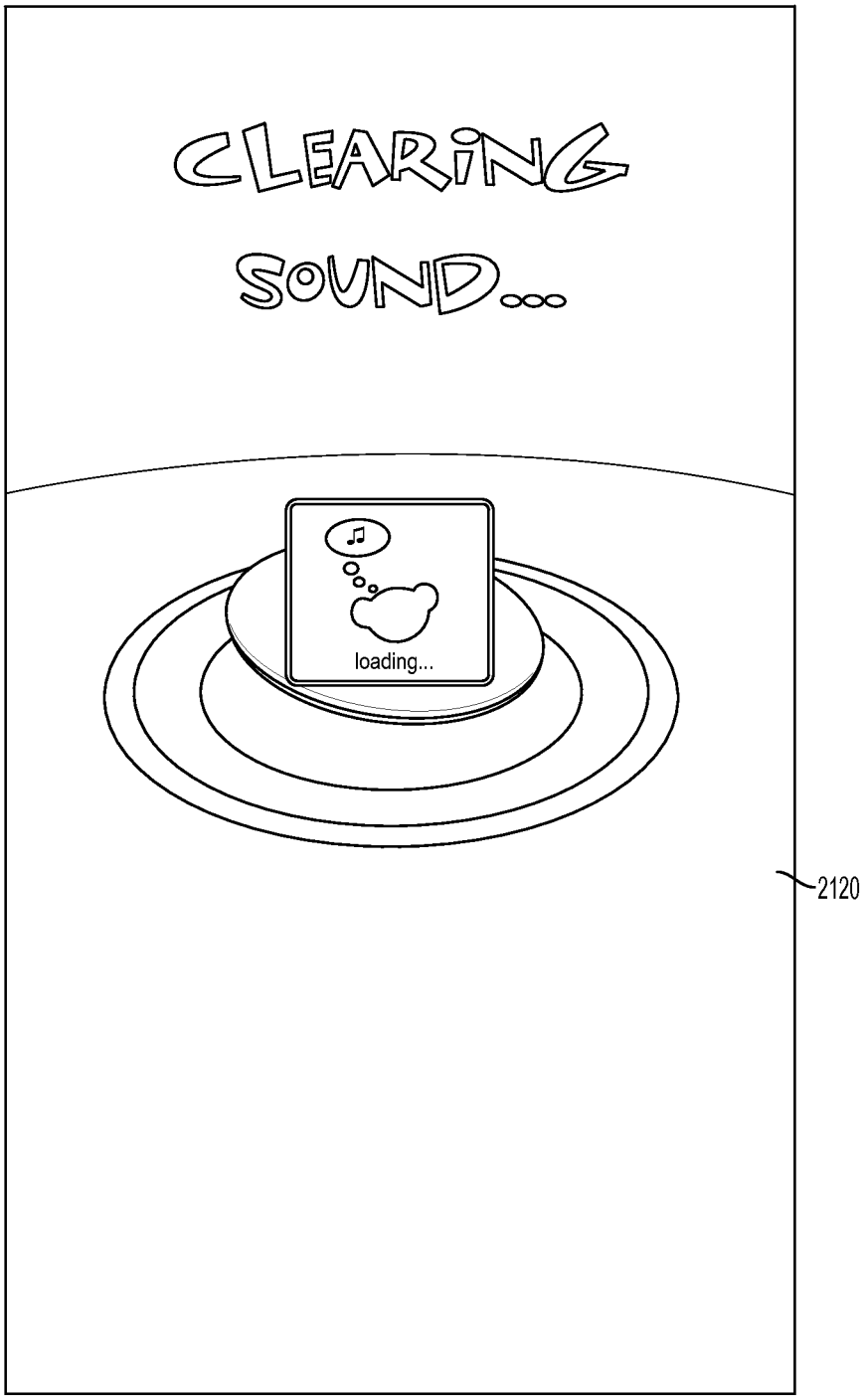
Figure 23:
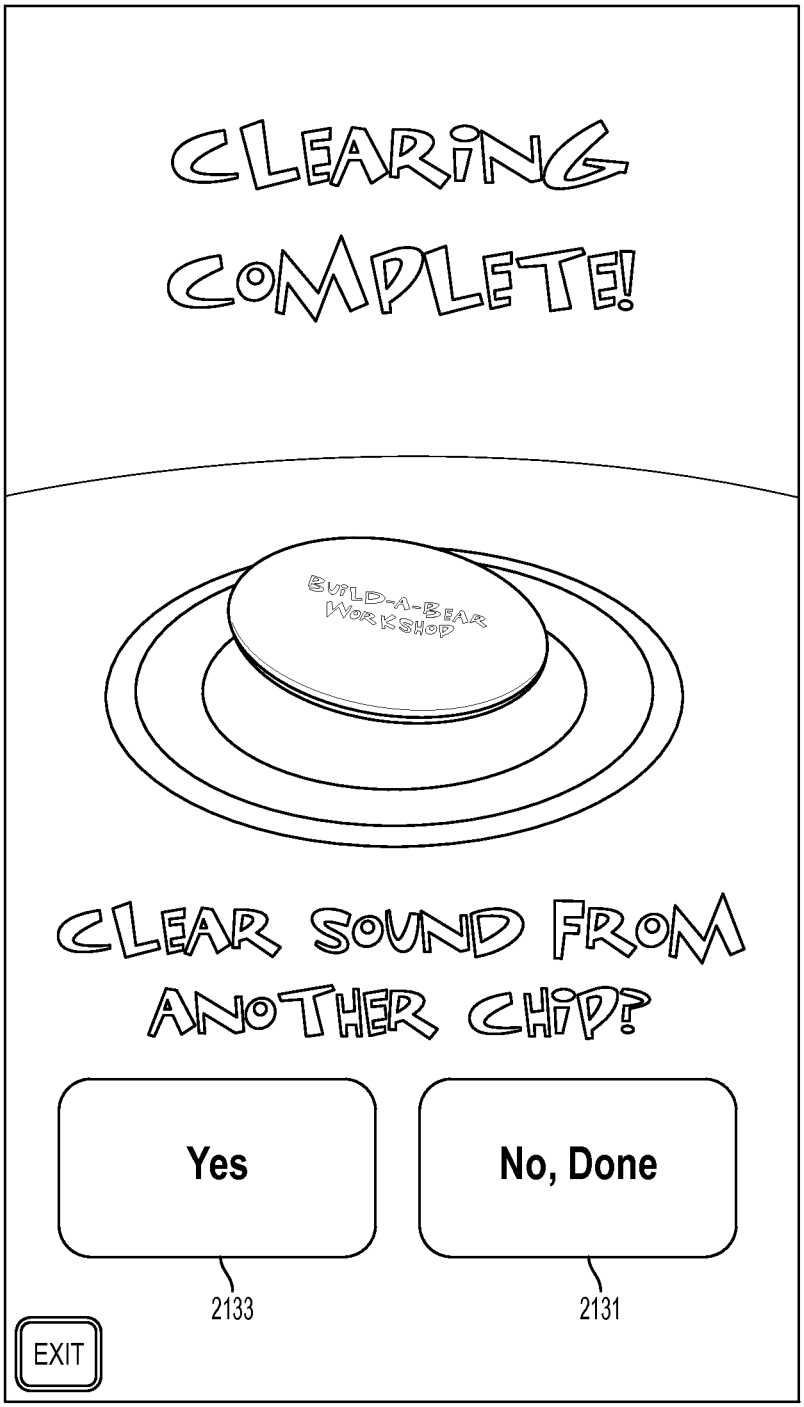

FIGS. 21 through 23 provide for screenshot animation of the embodiment of an operation to erase sounds on local storage devices (109). While such functionality is generally unnecessary as previously recorded local storage devices (109) can simply be returned to a bin (107) and be recorded over later, it may be desired if a final consumer was to record an undesirable recording on a local storage device (109) and then not purchase the local storage device (109). For example, as the kiosk (100) will often be used by children, a final consumer could record a vulgar, inappropriate, or undesirable sound on a local storage device (109) which the owner of the kiosk (100) wants to insure a future final consumer does not inadvertently play.

The process of erasing a previously recorded local storage device (109) is essentially the same as that of recording a sound. The administrative user is cued (2110) to place the local storage device to be erased in the cradle (113). The local storage device (109) is erased (which may be accomplished by recording sound having no audible component on the local storage device or simply by losing pointer information for existing sound files on the local storage device (109)). An animation can again be used to indicate that such erasure is commencing (2120). The administrative user is again cued if they are done erasing chips (2131) or wish to erase further chips (2133) to allow them to perform the erasure activity repeatedly in a relatively short period of time, if necessary.

In some cases, an administrative user may wish to record a plurality of local storage devices with the same sound. This could be, for example, because the administrative user is generating a number of premanufactured toys for ready sale or because a final consumer wishes to purchase sounds for a plurality of toys. This could occur, for example, at a birthday party where the same sound is being purchased for all the individuals at the birthday party who are each making their own toys.

Figure 24:
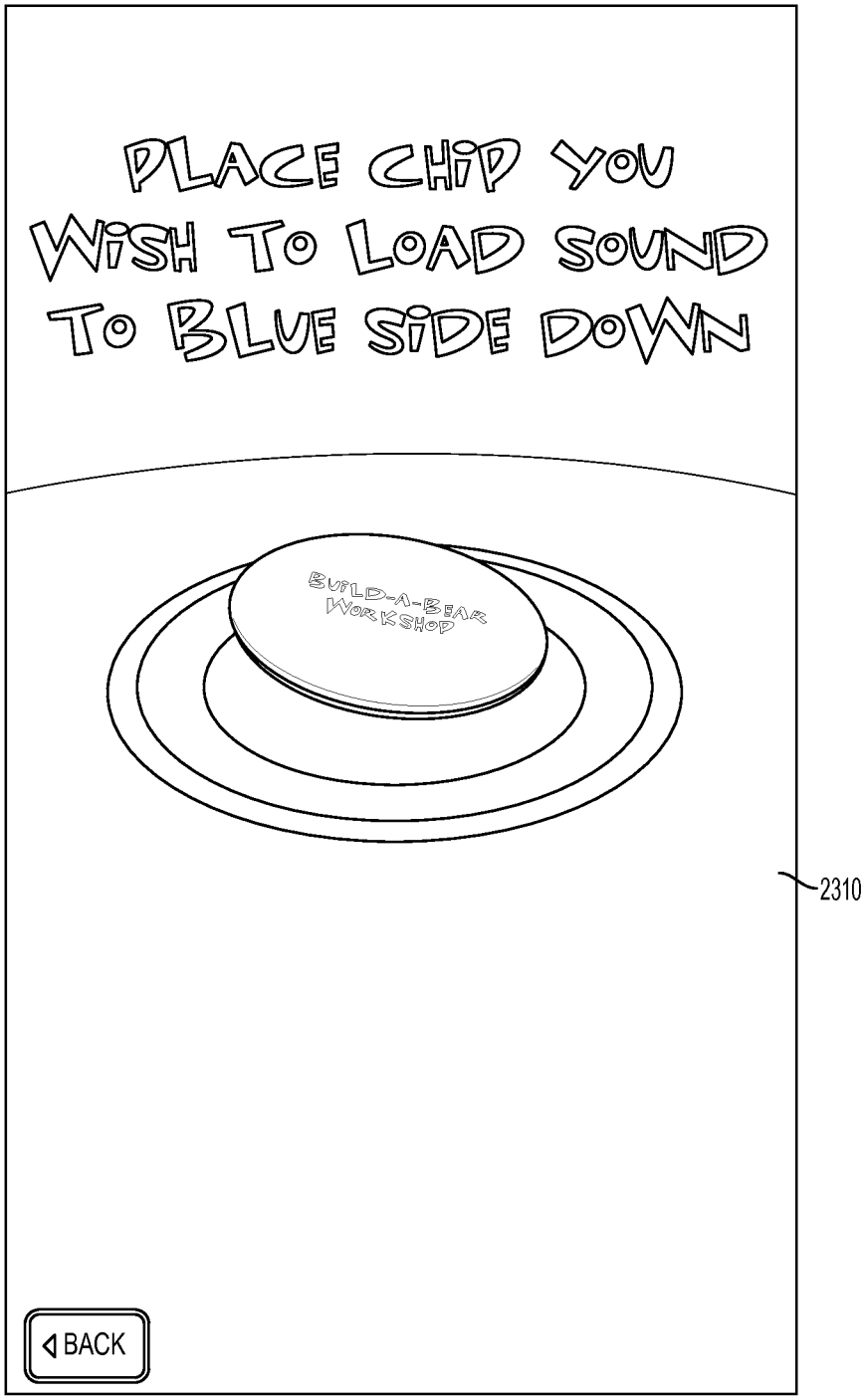
FIGS. 24-26 provide for screenshots of an embodiment of software for administrative loading of duplicate sounds on multiple local storage devices.
Figure 25:
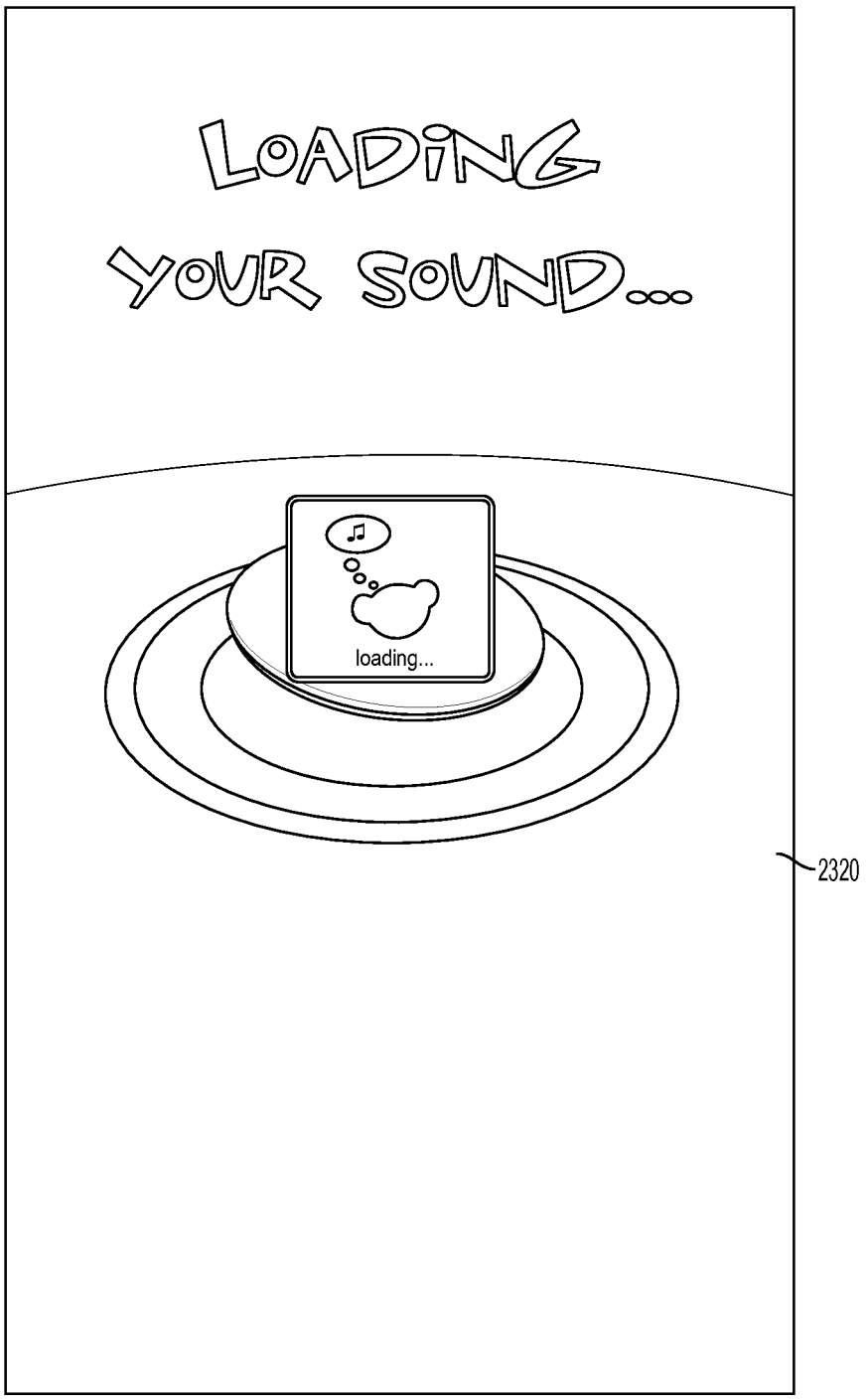
Figure 26:
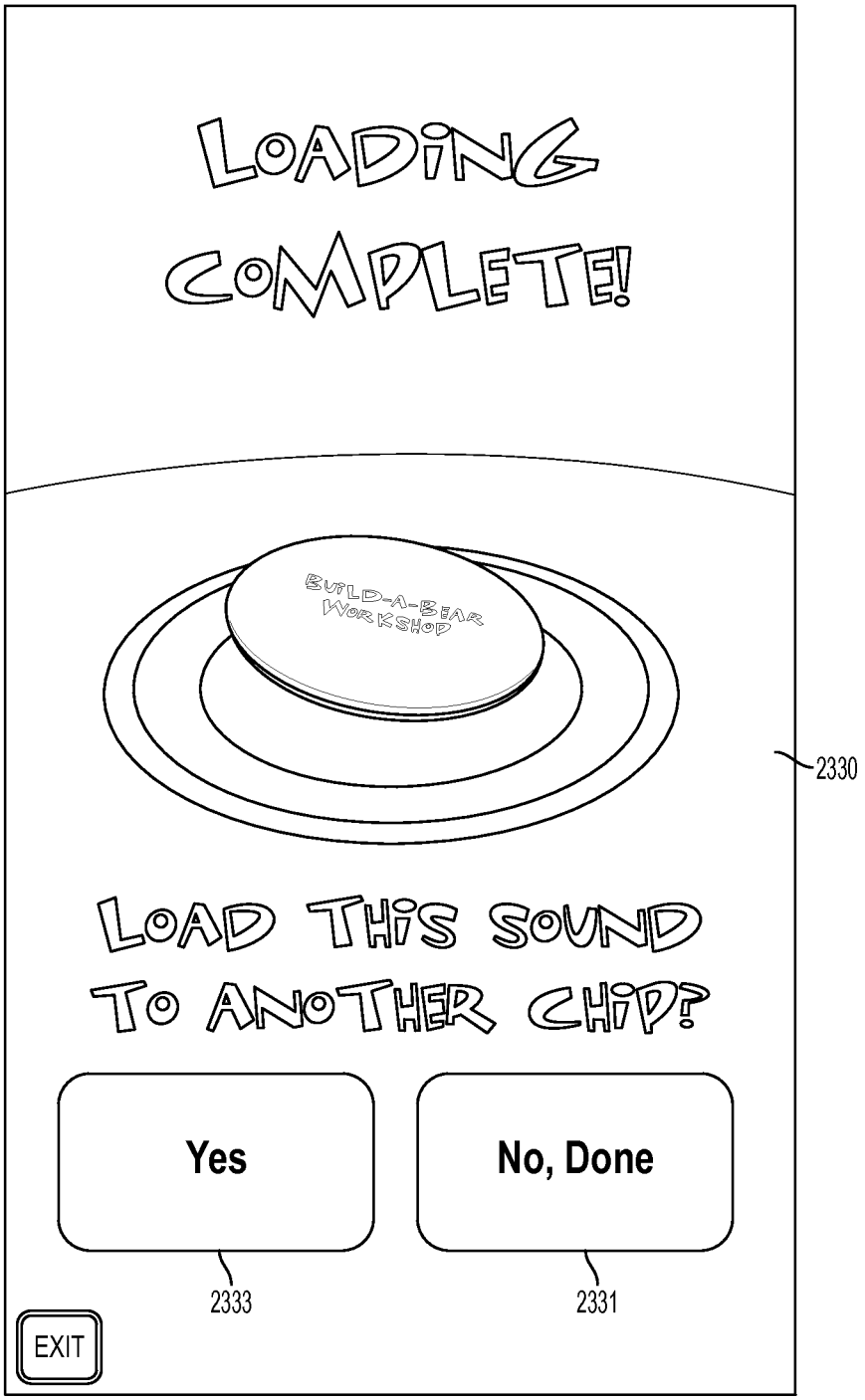

FIGS. 24-26 provide a walk-through of screenshots seen by an administrative user performing a multiple device recording. The cue to place the local storage device (2310), the hold screen as the recording occurs (2320) and the decision (2330) to record another chip (2333) or to complete the process (2331) are very similar to those provided as part of the recording by a final consumer in FIGS. 14-17 and the administrative erasure procedure of FIGS. 21-23. The major difference between the administrative user procedure and the final consumer procedure for recording is that the administrative procedure will generally not allow access to the sound files and menus of FIGS. 7-10 between separate transfer processes so as to expedite the process of repeated recording. Similarly, the buying process where the transfer of the sound to the local storage device (109) creates a shopping cart element is generally suspended.

While the embodiments discussed above provide for the recording of sound to the local storage device (109), it should be recognized that the local storage device (109) is effectively a computer and memory which can provide for limited independent control, but can be controlled via an exterior computer in the nature of the kiosk (100) via the cradle (113) in order to effectuate the sound transfer. In additional embodiments, the cradle (113) can be made to not require proximity to the local storage device (109) and/or to identify the local storage device (109) to the final consumer prior to the transfer taking place. Further, sound stored in a digital medium is effectively just data. As such, the local storage device (109) can become a generally interactive device which can be used to store data or to provide for certain limited additional functionality to the toy.

The storage of data on the local storage device (109) can allow for the local storage device (109) to serve to identify the toy, including its owner and various information with which the final consumer has provided the toy, for example, a name. When the chip is therefore presented to a cradle (113) or other device capable of communicating with it, this data may be retrieved to provide for an improved interactive experience. For example, the company providing the toy may provide an online computerized environment or social network where an owner of the toy can interact with other consumers and with computer games and simulations using the toy. In such an environment, the presence of the toy can be detected, the data can be loaded to the interactive environment, and this can provide for improved interactivity of the toy within the interactive environment and a more seamless integration of the toy with the environment.

Similarly, as the data on the local storage device (109) is carried with the toy, should the toy become lost, the data could be retrieved from the toy by those who have capability to access the data. In this way, a lost toy could be returned to its owner when it is turned into a store of the type where it was obtained.

Still further, because the local storage device (109) can include data other than sound, the local storage device can also be used to control other components of the toy or of an associated interactive environment. For instance, data on the toy could instruct lighting which is part of the toy to light up in time with music as it is played or could control light and sound functions independently. Alternatively, the local storage device could provide a form animation to the toy causing parts to move or causing objects the toy is interacting with to operate. For example, the local storage device (109) could interact with a toy phone that the original toy is using to provide for its display.

In another embodiment, an interactive environment can also interact more directly with a toy via the local storage device (109). For example, the interactive environment can include a transmitter which is capable of utilizing free memory on the local storage device (109) to download additional sound or functionality to the toy. For example, if the local storage device (109) has free space, an interactive game may download, as part of its operational procedure, certain sounds to the local storage device (109) during gameplay. Upon completion of a portion of the game, the toy can then provide words of encouragement to the child (who is presumably playing the game with the toy) based on their performance in the game. In the event that that game is designed to be something carried out interactively by the toy and child, this can provide a more immersive experience than if the sound issues from the interactive game representation of the toy. The toy and interactive environment can also operate in the reverse direction with the final consumer using the toy as a controller in the interactive environment. For example, the local storage device (109) could detect that an appendage of the toy is moving and pass that information to the interactive environment so an in-screen representation of the toy moves the same way. This type of interactivity can be facilitated by having additional electronics inside the toy where the local storage device (109) operates more as a central processor for a variety of external functions.

Further, the computational and data storage capability of the local storage device (109) being connected the toy can also provide for a more personalized environment. For example, the toy can be programmed with a personality type which may then affect the types of sound clips to be downloaded (or the voice used to play the sound clips). For example a toy with a more sensitive personality could protest if squeezed too hard, while a toy with a more aggressive personality could encourage the final consumer to squeeze them harder. Similarly, a female toy could provide the same sounds with a more traditionally female voice while a male toy may provide the same sounds with a more traditionally male voice. Still further, a final consumer may be provided with special events and tokens (commonly called "Easter eggs") for performing certain actions such as, but not limited to, winning a game or going to a store a preset number of times. The occurrence of these achievements can be recorded on the device and can allow the final consumer access to "locked" content or "unlock" new content that can be put on the toy.

In a still further embodiment, the local storage device (109) can be programmed remotely. For example, the toy may include wireless network capability or a connector for a wired connection to an external device (such as, but not limited to, a Universal Serial Bus (USB) jack). In this type of situation, even after sounds have been recorded to the toy and the toy has been taken home, additional sounds may be provided to the toy through later purchases (with or without returning to the kiosk (100)) or as rewards for the completion of certain activities. Generally, this functionality will require some form of identification mechanism so that the toy can be identified as one authorized to obtain the additional data and/or to identify that the device providing the additional data is also authorized to communicate with the toy in this fashion.

The ability to provide for a local storage device (109) which is programmed during the manufacture of the toy and/or at the point of sale of the data which is placed thereon provides for a wide range of additional functionality in the interactivity of the toy and manufacturing process. Sound can be transferred which is selected from a sound library by the final consumer instead of having to provide for prerecorded local storage devices. This provides for greatly increased functionality of each local storage device (109) as well as allowing for a greater availability of sounds.

Further, the inclusion of such a system (10) in a self-service manufacturing system can also dramatically improve the speed and simplicity at which a new sound is made available to final consumers. As the local storage devices are programmed at the time of purchase, the sound simply needs to be available on the server and/or kiosk (100) client computers at the time of purchase for the sound to be available to any and all final consumers. Therefore, there is no need to have sound chips preprogrammed (which is often performed in another country) and shipped prior to the sound being available. Thus, hit music can often be provided at the time it is becoming a hit, instead of later in its lifecycle and time sensitive sounds may also be provided easily.

Further, the ability of the final consumer to obtain specific sounds they desire is greatly enhanced as there is no need to warehouse sound chips. As such warehousing has previously been cost prohibitive when it comes to sounds that are of reduced popularity, such sounds were generally not provided at all. With the systems and methods discussed herein, sounds are stored virtually and hardware independent and therefore the warehousing cost of additional sounds is dramatically decreased providing for a much greater selection without major cost constraints being imposed.

Because the warehousing of sound data is independent of the local storage device (109), hardware costs can be significantly less expensive. Further, it is also possible, in an embodiment, to warehouse final consumer recorded sounds for later retrieval. In this embodiment, when a final consumer elects to record a sound which is then purchased (the process of FIGS. 11-13), the sound is stored in local memory on the kiosk (100) client computer and is then uploaded to the server computer at a convenient time. Access to this sound will generally be limited, as it may be personal and may be of no interest to other final consumers, but in the event that the toy is lost or damaged in the future, the sound may be retrieved by a high level administrator final consumer or through a specialized process to allow a toy to be recreated. This warehousing can be particularly valuable where the sound may have been originally recorded by a family member who is no longer able to record the sound again, for example, because they have died since the sound was recorded.

In this embodiment, the sound will generally be stored at the network server so that it can be retrieved from locations other than the original kiosk (100) and will also generally not be accessible to final consumers of the kiosk (100). Instead, an administrative user would require a final consumer to provide an identifier to show that they originally belonged to the sound. This may be through data on the local storage device (109) or may be through other means of linking a final consumer with a specific toy as are known to those of ordinary skill in the art or otherwise discussed herein. Once the final consumer is linked to the sound, the sound can then be specially retrieved by the administrative user and recorded on a new local storage device (109) to allow the toy to be recreated.

It should be recognized that the local storage device (109) utilizing current technology will have a limited lifespan as the batteries (197) will eventually discharge. It is preferred in this situation that the onboard memory not require power to store the sound so the sound is not lost due to power being unavailable for some period of time. The batteries may be replaced in order to reactive the local storage device (109) by temporarily removing the local storage device (109) from the toy's outer shell. In alternative embodiments, the batteries (197) and/or local storage device (109) may additionally or alternatively be provided with a system to remotely recharge from an external power source (e.g., wirelessly) to provide for an essentially indefinite lifespan without need to remove the local storage device (109) from the toy.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A system for providing sound to a toy, the system comprising:

a toy;

a local storage device external to said toy, said local storage device including:

a chipset comprising a local memory; and a speaker for reproducing sounds recorded on said local memory; and a housing enclosing said chipset;

a kiosk, the kiosk including:

a cradle for detecting the presence of said local storage device in said cradle;

a kiosk memory including a library of sounds; and a processor for transferring a sound from said library of sounds on said kiosk memory to said local memory on said local storage device while said local storage device is in said cradle;

wherein a final consumer instructs said processor to transfer said sound from said kiosk memory to said local memory while said local storage device is in said cradle; and wherein said local storage device is removed from said cradle and then placed in said toy by said final consumer after said sound is transferred from said kiosk memory to said local memory.

2. The system of claim 1 wherein said local storage device must be placed in said cradle for said processor to transfer said sound.

3. The system of claim 2 wherein said transferring occurs wirelessly.

4. The system of claim 1 wherein said final consumer interacts with said kiosk via a touchscreen.

5. The system of claim 1 wherein said toy comprises a plush toy.

6. The system of claim 1 wherein said kiosk further comprises a microphone.

7. The system of claim 6 wherein said sound is generated by said final consumer using said microphone.

8. The system of claim 7 wherein said kiosk further comprises sound processing software for modifying said sound.

9. The system of claim 7 wherein said sound is stored on a memory remote from said kiosk.

10. The system of claim 1 wherein said final consumer can load a sound from a remote memory into said kiosk memory.

11. The system of claim 1 wherein said kiosk identifies said toy.

12. The system of claim 11 wherein said kiosk utilizes a machine readable indicia associated with said toy to identify said toy.

* * * * *